US005198319A

United States Patent [19]

Kato

[11] Patent Number: 5,198,319

[45] Date of Patent: Mar. 30, 1993

[54] ELECTROPHOTOGRAPHIC LIGHT-SENSITIVE MATERIAL

[75] Inventor: Eiichi Kato, Shizuoka, Japan

[73] Assignee: Fuji Photo Film Co., Ltd., Kanagawa, Japan

[21] Appl. No.: 703,651

[22] Filed: May 21, 1991

[30] Foreign Application Priority Data

May 21, 1990 [JP] Japan ..... 2-129264

[51] Int. Cl.[5] ..... G03G 5/087

[52] U.S. Cl. ..... 430/96; 430/84; 430/49

[58] Field of Search ..... 430/96, 83, 84

[56] References Cited

U.S. PATENT DOCUMENTS

| | | | |
|---|---|---|---|
| 3,870,516 | 3/1975 | Smith et al. | 96/1.5 |
| 3,909,261 | 9/1975 | Jones | 96/1.5 |
| 4,954,407 | 9/1990 | Kato et al. | 430/96 |
| 5,009,975 | 4/1991 | Kato et al. | 430/96 |
| 5,030,534 | 7/1991 | Kato et al. | 430/96 |
| 5,089,368 | 2/1992 | Kato et al. | 430/96 |
| 5,110,701 | 3/1992 | Kato et al. | 430/96 |

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

An electrophotographic light-sensitive material comprising a support having provided thereon a photoconductive layer containing at least an inorganic photoconductive substance and a binder resin, wherein the binder resin comprises (1) at least one graft type copolymer (Resin (A)) having a weight average molecular weight of from $1\times10^3$ to $2\times10^4$ and containing, as a copolymerizable component, at least one mono-functional macromonomer (M) comprising an AB block copolymer being composed of an A block comprising at least one polymerizable component containing at least one acidic group selected from $-PO_3H_2$, $-COOH$, $-SO_3H$, a phenolic hydroxyl group, (wherein R represents a hydrocarbon group or —OR′ (wherein R′ represents a hydrocarbon group)) and a cyclic acid anhydride-containing group, and a B block containing at least one polymerizable component represented by the general formula (I) and having a polymerizable double bond group bonded to the terminal of the main chain of the B block polymer (I)

and (2) at least one resin (Resin (B)) having a weight average molecular weight of $5\times10^4$ or more, containing a repeating unit represented by the general formula (III) as a copolymerizable component, and having a cross-linked structure made before the preparation of a dispersion for forming the photoconductive layer (III)

16 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic characteristics and moisture resistance.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if desired, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. In particular, a direct electrophotographic lithographic plate has recently become important as a system for printing on the order of from several hundreds to several thousands of prints having a high image quality.

Binders which are used for forming the photoconductive layer of an electrophotographic light-sensitive material are required to be excellent in the film-forming properties by themselves and the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to pre-exposure and also have an excellent image forming properties, and the photoconductive layer stably maintains these electrostatic properties in spite of the change of humidity at the time of image formation.

Further, extensive studies have been made for lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

However, conventional binder resins used for electrophotographic light-sensitive materials have various problems particularly in electrostatic characteristics such as a charging property, dark charge retention characteristic and photosensitivity, and smoothness of the photoconductive layer.

In order to overcome the above problems, JP-A-63-217354, JP-A-1-70761 and JP-A-2-67563 (the term "JP-A" as used herein means an "unexamined Japanese patent application") disclose improvements in the smoothness of the photoconductive layer and electrostatic characteristics by using, as a binder resin, a resin having a low molecular weight and containing from 0.05 to 10% by weight of a copolymerizable component containing an acidic group in a side chain of the polymer, or a resin having a low molecular weight (i.e., a weight average molecular weight (Mw) of from $1\times10^3$ to $1\times10^4$) and having an acidic group bonded at the terminal of the polymer main chain thereby obtaining an image having no background stains. Also, JP-A-1-100554 and JP-A-1-214865 disclose a technique using, as a binder resin, a resin containing a polymerizable component containing an acidic group in a side chain of the copolymer or at the terminal of the polymer main chain and a polymerizable component having a heat- and/or photo-curable functional group; JP-A-1-102573 and JP-A-2-874 disclose a technique using a resin containing an acidic group in a side chain of the copolymer or at the terminal of the polymer main chain and a crosslinking agent in combination; JP-A-64-564, JP-A-63-220149, JP-A-63-220148, JP-A-1-280761, JP-A-1-116643 and JP-A-1-169455 disclose a technique using the above-described resin having a low molecular weight (a weight average molecular weight of from $1\times10^3$ to $1\times10^4$) and a resin having a high molecular weight (a weight average molecular weight of $1\times10^4$ or more) in combination; JP-A-1-211766 and JP-A-2-34859 disclose a technique using the above described low molecular weight resin and a heat- and/or photo-curable resin in combination; and JP-A-2-53064, JP-A-2-56558 and JP-A-2-103056 disclose a technique using the above described low molecular weight resin and a comb-like polymer in combination. These references disclose that, according to the proposed technique, the film strength of the photoconductive layer can be increased sufficiently and also the mechanical strength of the light-sensitive material can be increased without adversely affecting the above-described electrostatic characteristics owing to the use of a resin containing an acidic group in a side chain of the copolymer or at the terminal of the polymer main chain.

However, it has been found that, even in the case of using these resins, it is yet insufficient to keep the stable performance in the case of greatly changing the environmental conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

Further, when the scanning exposure system using a semiconductor laser beam is applied to hitherto known light-sensitive materials for electrophotographic lithographic printing plate precursors, various problems may occur in that the difference between $E_{\frac{1}{2}}$ and $E_{1/10}$ is particularly large and the contrast of the reproduced image is decreased, in addition to the insufficient electrostatic characteristics described above. Moreover, it is difficult to reduce the remaining potential after exposure, which results in severe fog formation in duplicated images, and when employed as offset masters, edge marks of originals pasted up appear on the prints.

SUMMARY OF THE INVENTION

The present invention has been made for solving the problems of conventional electrophotographic light-sensitive materials as described above and meeting the requirement for the light-sensitive materials.

An object of the present invention is to provide an electrophotographic light-sensitive material having stable and excellent electrostatic characteristics and giving clear good images even when the environmental conditions during the formation of duplicated images are changed to a low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of the present invention is to provide an electrophotographic lithographic printing plate precursor having excellent electrostatic characteristics (in particular, dark charge retention characteristics, and photosensitivity), capable of reproducing faithfully duplicated images to original, forming neither overall background stains, dotted background stains nor edgemarks of original pasted up on prints, and showing excellent printing durability.

Other objects of the present invention will become apparent from the following description and examples.

It has been found that the above described objects of the present invention are accomplished by an electrophotographic light-sensitive material comprising a support having provided thereon a photoconductive layer containing at least an inorganic photoconductive substance and a binder resin, wherein the binder resin comprises (1) at least one graft type copolymer (Resin (A)) having a weight average molecular weight of from $1\times10^3$ to $2\times10^4$ and formed from, as a copolymerizable component, at least one mono-functional macromonomer (M) comprising an AB block copolymer being composed of an A block comprising at least one polymerizable component containing at least one acidic group selected from $-PO_3H_2$, —COOH, $-SP_3H$, a phenolic hydroxyl group,

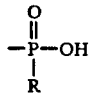

(wherein R represents a hydrocarbon group or —OR' (wherein R' represents a hydrocarbon group)) and a cyclic acid anhydride-containing group, and a B block containing at least one polymer component represented by the general formula (I) described below and having a polymerizable double bond group bonded to the terminal of the main chain of the B block polymer:

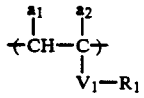

(I)

wherein $a_1$ and $a_2$ each represents a hydrogen atom, a halogen atom, a cyano group, a hydrocarbon group, $-COOZ_1$ or $-COOZ_1$ bonded via a hydrocarbon group (wherein $Z_1$ represents a hydrocarbon group); $V_1$ represents —COO—, —OCO—, $-(CH_2)_{l_1}-OCO-$, $-(CH_2)_{l_2}-COO-$ (wherein $l_1$ and $l_2$ each represents an integer of from 1 to 3), —O—, $-SO_2-$, —CO—,

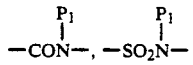

(wherein $P_1$ represents a hydrogen atom or a hydrocarbon group), —CONHCOO—, —CONHCONH—, or

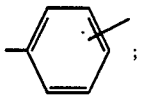

and $R_1$ represents a hydrocarbon group, provided that when $V_1$ represents

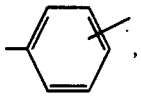

$R_1$ represents a hydrogen atom or a hydrocarbon group; and (2) at least one resin (Resin (B) having a weight average molecular weight of $5\times10^4$ or more, containing a repeating unit represented by the general formula (III) described below, as a copolymer component, and having a crosslinked structure made before the preparation of a dispersion for forming the photoconductive layer:

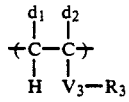

(III)

wherein $V_3$ represents —COO—, —OCO—, $-CH_2OCO-$, $-CH_2COO-$, —O—, or $-SO_2-$; $R_3$ represents a hydrocarbon group having from 1 to 22 carbon atoms; and $d_1$ and $d_2$, which may be the same or different, each represents a hydrogen atom, a halogen atom, a cyano group, a hydrocarbon group having from 1 to 8 carbon atoms, $-COOZ_3$, or $-COOZ_3$ bonded through a hydrocarbon group having from 1 to 8 carbon atoms, wherein $Z_3$ represents a hydrocarbon group having from 1 to 18 carbon atoms.

DETAILED DESCRIPTION OF THE INVENTION

The binder resin which Can be used in the present invention is characterized by comprising at least (1) a graft type copolymer (hereinafter referred to as resin (A)) formed from, as a copolymerizable component, a mono-functional macromonomer (M) comprising an AB block copolymer composed of an A block comprising at least one polymer component containing the specific acidic group and a B block comprising a polymer component represented by the general formula (I), and having a polymerizable double bond group bonded to the terminal of the main chain of the B block polymer, and (2) a high-molecular weight resin (hereinafter referred to as resin (B)) having the crosslinked structure previously made.

The low molecular weight resin among acidic group-containing binder resins which are known to improve the smoothness and the electrostatic characteristics of the photoconductive layer described above is a resin wherein acidic group-containing polymer components exist at random in the polymer main chain; or a resin wherein an acidic group is bonded to only one terminal of the polymer main chain.

On the other hand, the graft type copolymer used as the binder resin according to the present invention has a chemical structure of the polymer chain which is specified in such a manner that the acidic groups contained in the resin exist as a block (i.e., the A block) in the graft portion apart from the copolymer main chain.

It is presumed that, in the graft type copolymer used in the present invention, the acidic groups maldistributed at the terminal portion of the graft part of the polymer is sufficiently adsorbed on the stoichiometric defect of the inorganic photoconductive substance and other portions of the graft part of the polymer mildly but sufficiently cover the surface of the photoconductive substance. Also, it is presumed that, even when the stoichiometric defect portion of the inorganic photoconductive substance varies to some extents, it always keeps a stable interaction between the inorganic photoconductive substance and the copolymer (resin (A)) used in the present invention since the resin has the above described sufficiently adsorbed domain by the function and mechanism of the sufficient adsorption onto the surface of the photoconductive substance and the mild covering as described above as compared with known resins. Thus, it has been found that, according to the present invention, the traps of the inorganic photoconductive substance are more effectively and sufficiently compensated and the humidity characteristics of the photoconductive substance are improved as compared with conventionally known acidic group-containing resins. Further, in the present invention, particles of the inorganic photoconductive substance are sufficiently dispersed in the binder to restrain the occurrence of the aggregation of the particles of the photoconductive substance.

Further, according to the present invention, the smoothness of the surface of the photoconductive layer can be further improved.

If an electrophotographic light-sensitive material having a photoconductive layer of a coarse surface is used as a lithographic printing plate precursor by an electrophotographic system, the photoconductive layer is formed in a state that the dispersion state of the particles of an inorganic photoconductive substance such as zinc oxide particles and a binder resin is improper and aggregates of the particles exist. When an oil-desensitizing treatment with an oil-desensitizing solution is applied thereto, the non-image areas are not uniformly and sufficiently rendered hydrophilic to cause attaching of a printing ink at printing, which results in the formation of background stains at the non-image areas of the prints obtained.

On the other hand, the resin (B) serves to sufficiently heighten the mechanical strength of the photoconductive layer, which may be insufficient in case of using the resin (A) alone, without damaging the excellent electrophotographic characteristics attained by the use of the resin (A). Further, the excellent image forming performance can be maintained even when the environmental conditions are greatly changed as described above or in the case of conducting a scanning exposure system using a laser beam of low power.

The polymer components of the macromonomer (M) in the resin (A) according to the present invention are composed of the A block and the B block as described above, and the ratio of the A block/the B block is preferably 1 to 70/99 to 30 by weight, and more preferably 3 to 50/97 to 50 by weight.

The ratio of the macromonomer (M)/other monomers (for example, these represented by the general formula (II) described hereinafter) in the graft type copolymer (the resin (A)) according to the present invention is preferably 1 to 60/99 to 40 by weight, and more preferably 5 to 40/95 to 60 by weight.

The content of the acidic group-containing component present in the macromonomer (M) of the resin (A) according to the present invention is preferably from 1 to 20 parts by weight, and more preferably from 3 to 15 parts by weight per 100 parts by weight of the resin (A).

The content of the acidic group present in the resin (A) described above can be adjusted to a preferred range by appropriately selecting the ratio of the A block present in the macromonomer (M) and the copolymerization ratio of the macromonomer (M) in the resin (A).

In the resin (A), a component copolymerizable with the macromonomer (M) is preferably a monomer represented by the following general formula (II):

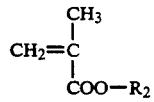

(II)

wherein $R_2$ represents a hydrocarbon group.

In the present invention, of the monomers represented by the general formula (II) which constitute a component copolymerizable with the macromonomer (M), a monomer represented by the following general formula (IIa) or (IIb) is preferred.

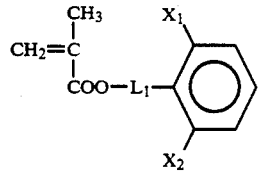

(IIa)

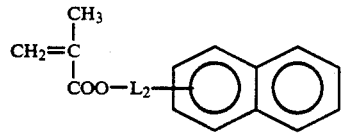

(IIb)

wherein $X_1$ and $X_2$ each, independently, represents a hydrogen atom, a hydrocarbon group having from 1 to 10 carbon atoms, a chlorine atom, a bromine atom, $-COZ_2$ or $-COOZ_2$ (wherein $Z_2$ represents a hydrocarbon group having from 1 to 10 carbon atoms); and $L_1$ and $L_2$ each represents a mere bond or a linking group having from 1 to 4 linking atoms, which connects —COO— and the benzene ring.

When a, resin (hereinafter sometimes referred to as resin (A')) formed from, as a monomer copolymerizable with the macromonomer (M), the methacrylate monomer having a substituted benzene or naphthalene ring-containing substituent represented by the general formula (IIa) or (IIb) is used, the electrophotographic characteristics, particularly, $V_{10}$, DRR and $E_{1/10}$ of the electrophotographic material can be furthermore improved. While the reason of this fact is not fully clear, it is believed that the polymer molecular chain of the resin (A') suitably arranges on the surface of inorganic photoconductive substance such as zinc oxide in the layer owing to the plane effect of the benzene ring having a substituent at the ortho position or the napthalene ring which is an ester component of the methacrylate whereby the above described improvement is achieved.

If the molecular weight of the resin (A) is less than $1\times10^3$, the film-forming ability thereof is undesirably reduced, whereby the photoconductive layer formed cannot keep a sufficient film strength. On the other hand, if the molecular weight thereof is larger than $2\times10^4$, the fluctuations of electrophotographic characteristics (in particular, initial potential and dark decay retention rate) of the photoconductive layer become somewhat large and thus the effect for obtaining stable duplicated images according to the present invention is reduced under severe conditions of high temperature and high humidity or low temperature and low humidity.

The glass transition point of the resin (A) is preferably from −40° C. to 110° C.

Further, if the content of the macromonomer in the resin (A) is less than 1% by weight, electrophotographic characteristics (particularly dark decay retention rate and photosensitivity) may be reduced and the fluctuations of electrophotographic characteristics of the photoconductive layer, particularly that containing a spectral sensitizing dye for the sensitization in the range of from near-infrared to infrared become large under severe conditions. The reason therefor is considered that the construction of the polymer becomes similar to that of a conventional homopolymer or random copolymer resulting from the slight amount of macromonomer portion present therein.

On the other hand, the content of the macromonomer in the resin is more than 60% by weight, the copolymerizability of the macromonomer with other monomers corresponding to other copolymer components may become insufficient, and the sufficient electrophotographic characteristics can not be obtained as the binder resin.

In the present invention, it is also preferred that the high-molecular weight resin (B) is a resin (hereinafter sometimes referred to as resin (B')) in which at least one polymer main chain has at least one polar group selected from $-PO_3H_2$, $-SO_3H$, $-COOH$, $-OH$, $-SH$,

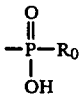

(wherein $R_0$ represents a hydrocarbon group or $-OR_0'$, wherein $R_0'$ represents a hydrocarbon group), a cyclic acid anhydride-containing group, $-CHO$, $-CONH_2$, $-SO_2NH_2$, and

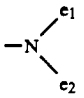

(wherein $e_1$ and $e_2$, which may be the same or different, each represents a hydrogen atom or a hydrocarbon group) at only one terminal thereof.

The ratio of the resin (A)/the resin (B) used is not particularly restricted, but ranges preferably 5 to 60/95 to 40 by weight, preferably 10 to 50/90 to 50 by weight.

It is believed that the excellent characteristics of the electrophotographic light-sensitive material according to the present invention can be obtained by employing the resin (A) and the resin (B) as binder resins for the inorganic photoconductive substance, wherein the weight average molecular weight of the resins, and the content and position of the acidic groups therein are specified, whereby the strength of interactions between the inorganic photoconductive substance and the resins can be appropriately controlled. More specifically, it is believed that the electrophotographic characteristics and mechanical strength of the layer can be greatly improved as described above by the fact that the resin (A) having a relatively strong interaction to the inorganic photoconductive substance selectively adsorbs thereon; whereas, the resin (B) having the adequately crosslinked structure causes an interaction between the polymer chains and the resin (B') further having the polar group at only one terminal of the main chain further causes a weak interaction between the polar group and the inorganic photoconductive particle.

If the low-molecular weight resin (A) according to the present invention is used alone as the binder resin, the resin can sufficiently adsorb onto the photoconductive substance and cover the surface thereof and thus, the photoconductive layer formed is excellent in the surface smoothness and electrostatic characteristics, provides images free from background fog and maintains a sufficient film strength for a CPC light-sensitive material or for an offset printing plate precursor giving several thousands of prints. When the resin (B) is employed together with the resin (A) in accordance with the present invention, the mechanical strength of the photoconductive layer, which may be yet insufficient by the use of the resin (A) alone, can be further increased without damaging the above-described high performance of the electrophotographic characteristics due to the resin (A). Therefore, the electrophotographic light-sensitive material of the present invention can maintain the excellent electrostatic characteristics even when the environmental conditions are widely changed, possess a sufficient film strength and form a printing plate which provides more than 8,000 prints under severe printing conditions, for example, when high printing pressure is applied in a large size printing machine.

Now, the resin (A) used in the present invention will be described in more detail below.

The mono-functional macromonomer (M) which can be employed in forming the graft type copolymer (the resin (A)) according to the present invention is described in greater detail below.

The acidic group contained in a component which constitutes the A block of the macromonomer (M) includes $-PO_3H_2$, $-COOH$, $-SO_3H$, a phenolic hydroxy group

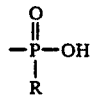

(R represents a hydrocarbon group or $-OR'$ (wherein R' represents a hydrocarbon group)), and a cyclic acid anhydride-containing group, and the preferred acidic groups are —COOH, —$SO_3H$, a phenolic hydroxy group and

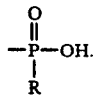

In the acidic group

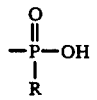

above, R represents a hydrocarbon group or OR', wherein R' represents a hydrocarbon group. The hydrocarbon group represented by R or R' preferably includes an aliphatic group having from 1 to 22 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

Examples of the phenolic hydroxy group include a hydroxy group of hydroxy-substituted aromatic compounds containing a polymerizable double bond and a hydroxy group of (meth)acrylic acid esters and amides each having a hydroxyphenyl group as a substituent.

The cyclic acid anhydride-containing group is a group containing at least one cyclic acid anhydride. The cyclic acid anhydride to be contained includes aliphatic dicarboxylic acid anhydrides and aromatic dicarboxylic acid anhydrides.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalene-dicarboxylic acid anhydride ring, pyridine-dicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

The polymerizable component containing the specific acidic group may be formed from any of acidic group-containing vinyl compounds copolymerizable with a copolymerizable monomer corresponding to a component constituting the B block of the macromonomer (M), for example, the methacrylate component represented by the general formula (II). Examples of such vinyl compounds are described, e.g., in Kobunshi Gakkai (ed.), *Kobunshi Data Handbook* (*Kisohen*), Baifukan (1986). Specific examples of these vinyl monomers include acrylic acid, α- and/or β-substituted acrylic acids (e.g., α-acetoxy, α-acetoxymethyl, α-(2-amino)ethyl, α-chloro, α-bromo, α-fluoro, α-tributylsilyl, α-cyano, β-chloro, β-bromo, α-chloro-β-methoxy, and α, β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half esters of dicarboxylic acids, and ester or amide derivatives of these carboxylic acids or sulfonic acids containing the acidic group in the substituent thereof.

Specific examples of the acidic group-containing copolymerizable components are set forth below, but the present invention should not be construed as being limited thereto. In the following examples, a represents —H, —$CH_3$, —Cl, —Br, —CN, —$CH_2COOCH_3$, or —CH2COOH; b represents —H or —$CH_3$, n represents an integer of from 2 to 18; m represents an integer of from 1 to 12; and l represents an integer of from 1 to 4.

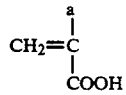
(a-1)

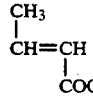
(a-2)

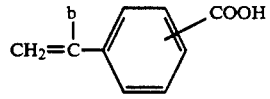
(a-3)

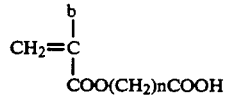
(a-4)

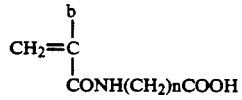
(a-5)

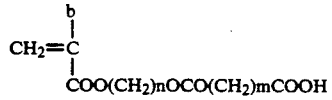
(a-6)

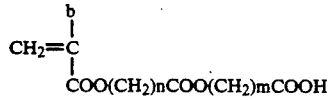
(a-7)

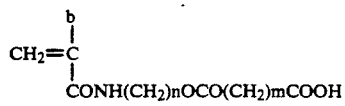
(a-8)

-continued
(a-9)
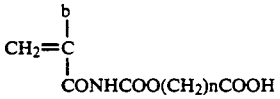
(a-10)
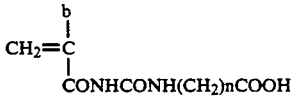
(a-11)
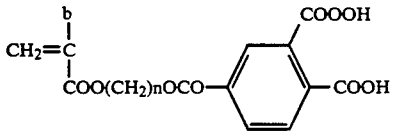
(a-12)
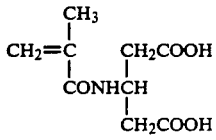
(a-13)
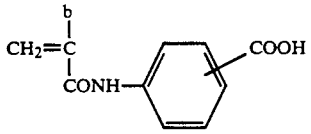
(a-14)
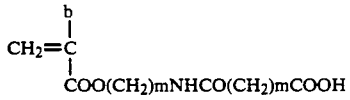
(wherein m's may be the same or different)
(a-15)
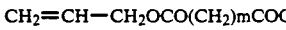
(a-16)
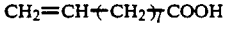
(a-17)
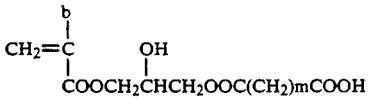
(a-18)
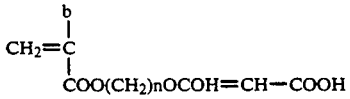
(a-19)
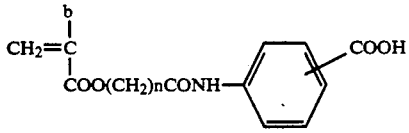
(a-20)
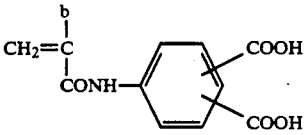
(a-21)
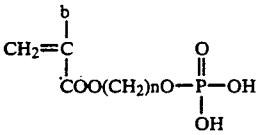
-continued
(a-22)
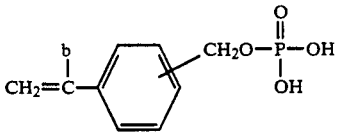
(a-23)
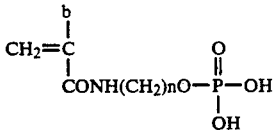
(a-24)
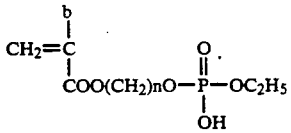
(a-25)
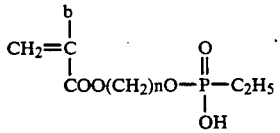
(a-26)
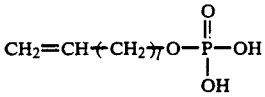
(a-27)
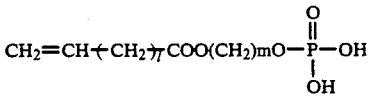
(a-28)
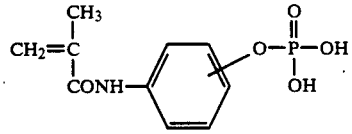
(a-29)
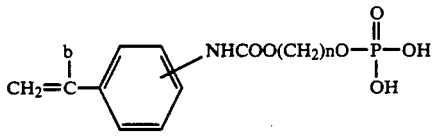
(a-30)
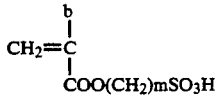
(a-31)
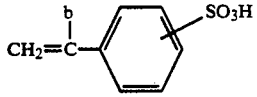
(a-32)
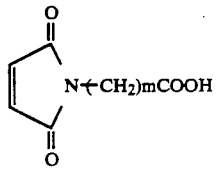

-continued (a-33)

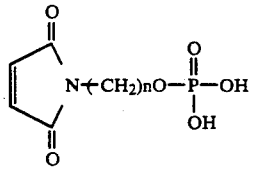

(a-34)

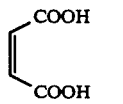

(a-35)

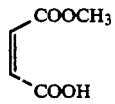

(a-36)

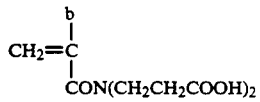

(a-37)

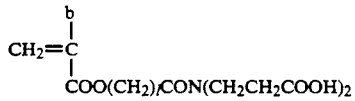

(a-38)

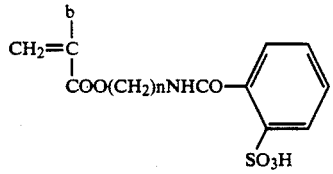

(a-39)

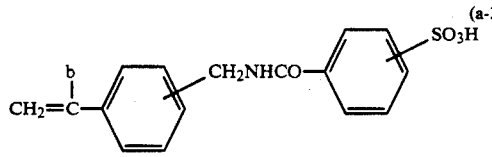

(a-40)

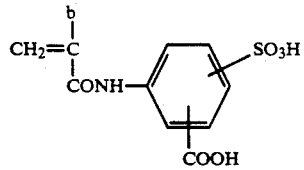

(a-41)

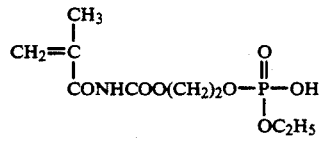

(a-42)

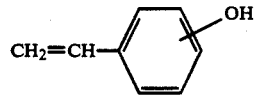

(a-43)

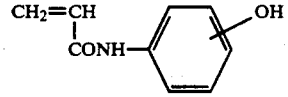

-continued (a-44)

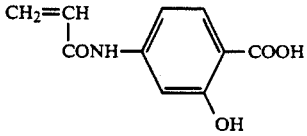

(a-45)

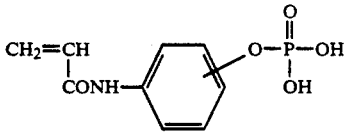

Two or more kinds of the above-described polymerizable components each containing the specific acidic group can be included in the A block. In such a case, two or more kinds of these acidic group-containing polymer components may be present in the form of a random copolymer or a block copolymer.

Also, other components having no acidic group may be contained in the A block, and examples of such components include the components represented by the general formula (I) described in detail below. The content of the component having the acidic group in the A block is preferably from 30 to 100% by weight.

Now, the polymer component represented by the general formula (I) constituting the B block in the mono-functional macromonomer of the graft type copolymer used in the present invention will be explained in more detail below.

In the general formula (I), $V_1$ represents —COO—, —OCO—, $-(CH_2)_{l1}-OCO-$, $-(CH_2)_{l2}-COO-$ (wherein $l_1$ and $l_2$ each represents an integer of from 1 to 3), —O—, —$SO_2$—, —CO—,

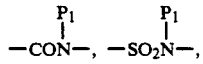

—CONHCOO—, —CONHCONH—, or

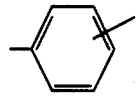

(wherein $P_1$ represents a hydrogen atom or a hydrocarbon group).

Preferred examples of the hydrocarbon group represent by $P_1$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarboxnylphenyl, butoxycarbonylphenyl, acetamidophenyl, propioamidophenyl, and dodecyloylamidophenyl).

In the general formula (I), $R_1$ represents a hydrocarbon group, and preferred examples thereof include those described for $P_1$. When $V_1$ represents

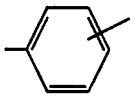

in the general formula (I), $R_1$ represents a hydrogen atom or a hydrocarbon group.

When $X_1$ represents

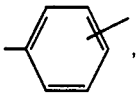

the benzene ring may be further substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

In the general formula (I), $a_1$ and $a_2$, which may be the same or different, each preferably represents a hydrogen atom, a halogen atom (e.g., chlorine, and bromine), a cyano group, an alkyl group having from 1 to 4 carbon atoms (e.g., methyl, ethyl, propyl, and butyl), —COO—$Z_1$ or —COO—$Z_1$ bonded via a hydrocarbon group, wherein $Z_1$ represents a hydrocarbon group (preferably an alkyl group, an alkenyl group, an aralkyl group, an alicyclic group or an aryl group, each of which may be substituted). More specifically, the examples of the hydrocarbon groups for $Z_1$ are those described for $P_1$ above. The hydrocarbon group via which —COO—$Z_1$ is bonded includes, for example, a methylene group, an ethylene group, and a propylene group.

More preferably, in the general formula (I), $V_1$ represents —COO—, —OCO—, —$CH_2$OCO—, —$CH_2$COO—, —O—, —CONH—, —$SO_2$HN— or

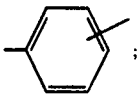

and $a_1$ and $a_2$, which may be the same or different, each represents a hydrogen atoms, a methyl group, —COO$Z_1$, or —$CH_2$COO$Z_1$, wherein $Z_1$ represents an alkyl group having from 1 to 6 carbon atoms (e.g., methyl, ethyl, propyl, butyl, and hexyl). Most preferably, either one of $a_1$ and $a_2$ represents a hydrogen atom.

Further, the B block may contain polymer components other than those represented by the general formula (I).

Suitable examples of monomer corresponding to the repeating unit copolymerizable with the polymerizable component corresponding to the represented by the general formula (I) to form a polymer component in the B block include acrylonitrile, methacrylonitrile and heterocyclic vinyl compounds (e.g., vinylpyridine, vinylimidazole, vinylpyrrolidone, vinylthiophene, vinylpyrazole, vinyldioxane, and vinyloxazine). Such other monomers are employed in a range of not more than 20 parts by weight per 100 parts by weight of the total polymer components in the B block.

Further, it is preferred that the B block does not contain the polymer component containing an acidic group which is a component constituting the A block.

When the B block contains two or more kinds of the polymer components, these polymer components may be contained in the B block in the form of a random copolymer or a block copolymer, but are preferably contained at random therein in view of the simple synthesis thereof.

As described above, the macromonomer (M) to be used in the present invention has a structure of the AB block copolymer in which a polymerizable double bond group is bonded to one of the terminals of the B block composed of the polymer component represented by the general formula (I) and the other terminal thereof is connected to the A block composed of the polymer component containing the acidic group. The polymerizable double bond group will be described in detail below.

Suitable examples of the polymerizable double bond group include those represented by the following general formula (IV):

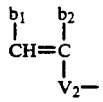

(IV)

wherein $V_2$ has the same meaning as $V_1$ defined in the general formula (I), and $b_1$ and $b_2$, which may be the same or different, each has the same meaning as $a_1$ and $a_2$ defined in the general formula (I).

Specific examples of the polymerizable double bond group represented by the general formula (III) include

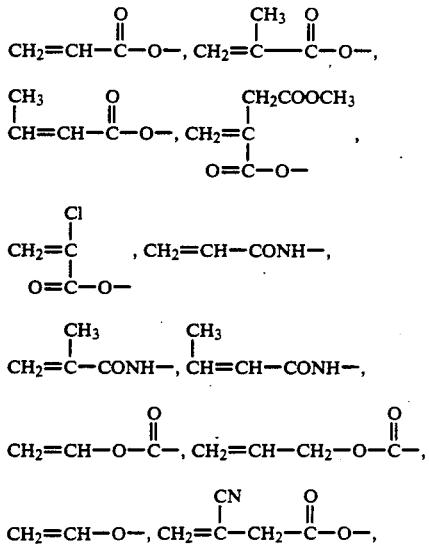

-continued

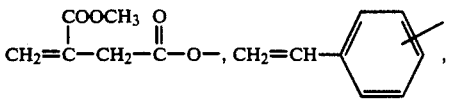

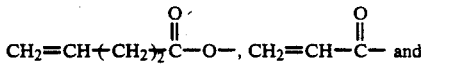

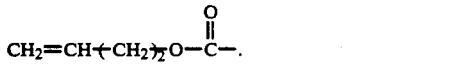

The macromonomer (M) used in the present invention has a structure in which a polymerizable double bond group preferably represented by the general formula (IV) is bonded to one of the terminals of the B block either directly or through an appropriate linking group.

The linking group which can be used includes a carbon-carbon bond (either single bond or double bond), a carbon-hetero atom bond (the hetero atom includes, for example, an oxygen atom, a sulfur atom, a nitrogen atom, and a silicon atom), a hetero atom-hetero atom bond, and an appropriate combination thereof.

More specifically, the linkage between the polymerizable double bond group and the terminal of the B block include a mere bond and a linking group selected from

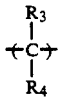

(wherein $R_3$ and $R_4$ each represents a hydrogen atom, a halogen atom (e.g., fluorine, chlorine, and bromine), a cyano group, a hydroxyl group, or an alkyl group (e.g., methyl, ethyl, and propyl)), $-CH=CH-$,

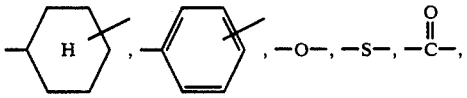

-continued

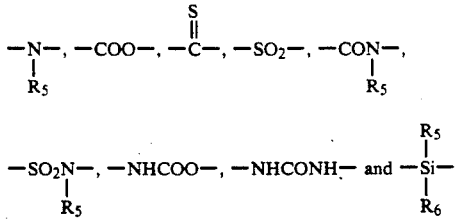

wherein $R_5$ and $R_6$ each represents a hydrogen atom or a hydrocarbon group having the same meaning as defined for $R_1$ in the general formula (I) described above), and an appropriate combination thereof.

If the weight average molecular weight of the macromonomer (M) exceeds $2\times10^4$, copolymerizability with other monomers, for example, those represented by the general formula (II) is undesirably reduced. If, on the other hand, it is too small, the effect of improving electrophotographic characteristics of the light-sensitive layer would be small. Accordingly, the macromonomer (M) preferably has a weight average molecular weight of at least $1\times10^3$.

The macromonomer (M) used in the present invention can be produced by a conventionally known synthesis method. More specifically, it can be produced by the method comprising previously protecting the acidic group of a monomer corresponding to the polymer component having the specific acidic group to form a functional group, synthesizing an AB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond group into the terminal of the resulting living polymer by a reaction with a various kind of reagents, and then conducting a protection-removing reaction of the functional group which has been formed by protecting the acidic group by a hydrolysis reaction, a hydrogenolysis reaction, an oxidative decomposition reaction, or a photodecomposition reaction to form the acidic group.

An example thereof is shown by the following reaction scheme (1):

Reaction Scheme (1)

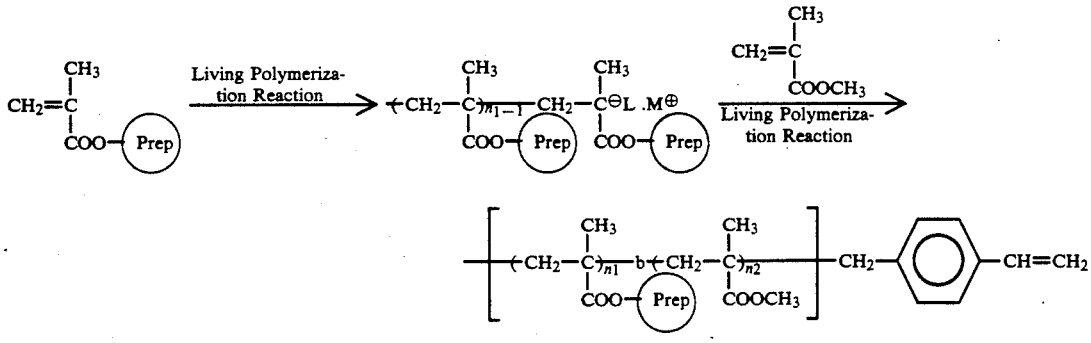

-continued

Reaction Scheme (1)

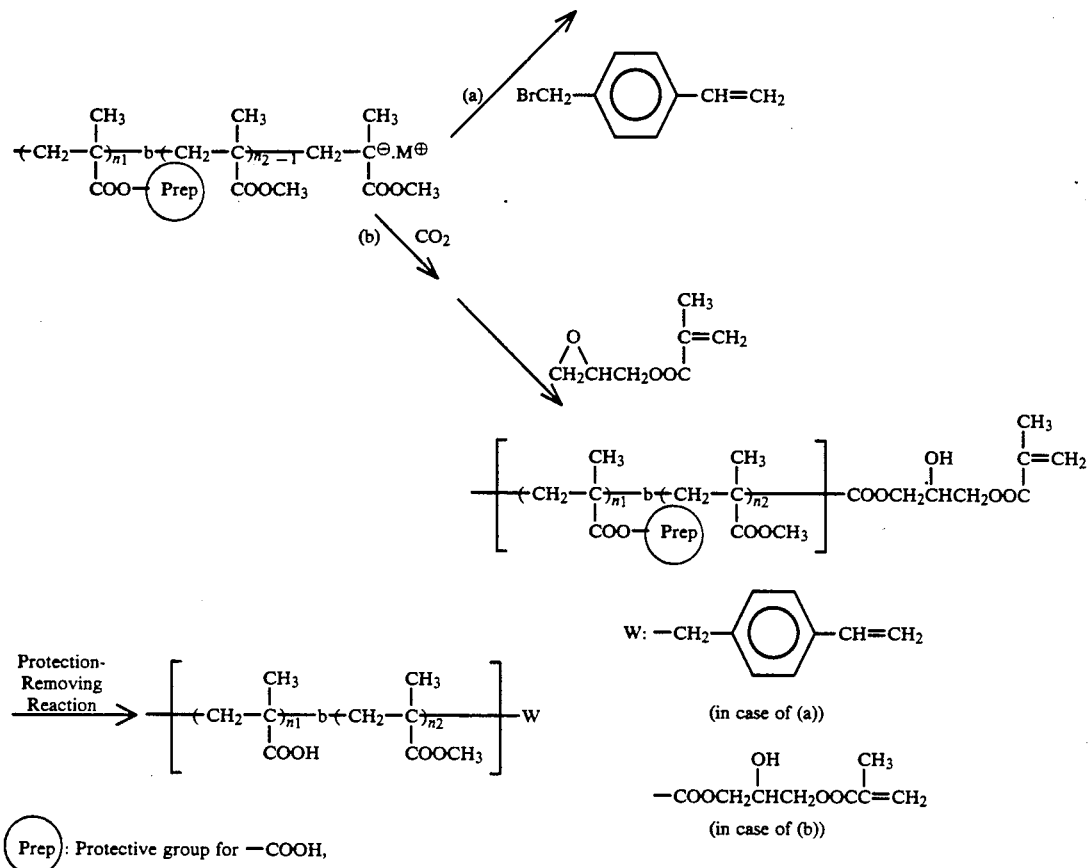

Prep: Protective group for —COOH,

-b-: "-b-" represents that each of the repeating units bonded to -b- is present in the form of a block polymer component (hereinafter the same).

$n_1$, $n_2$: repeating unit

The living polymer can be easily synthesized according to synthesis methods as described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Migite and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*), 46, 189 (1989), M. Kuroki and T. Aida, *J. Am. Chem. Soc.*, 109, 4737 (1987), Teizo Aida and Shohei Inoue, *Yuki Gosei Kagaku* (*Organic Synthesis Chemistry*), 43, 300 (1985), and D. Y. Sogoh W. R. Hertler et al, *Macromolecules*, 20, 1473 (1987).

In order to introduce a polymerizable double bond group into the terminal of the living polymer, conventionally known synthesis method for macromonomer can be employed.

For details, reference can be made, for example, to P. Dreyfuss and R. P. Quirk, *Encycl. Polym. Sci. Eng.*, 7, 551 (1987), P. F. Rempp and E. Franta, *Adv. Polym. Sci.*, 58, 1 (1984), V. Percec, *Appl. Polym. Sci.*, 285, 5 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino ZairVo*, 1987, No. 10, 5, and references cited in these literatures.

Also, the protection of the specific acidic group of the present invention and the release of the protective group (a reaction for removing a protective group) can be easily conducted by utilizing conventionally known knowledges. More specifically, they can be preformed by appropriately selecting methods as described, e.g., in Yoshio Iwakura and Keisuke Kurita, *Hannosei Kobunshi* (*Reactive Polymer*), Kodansha (1977), T. W. Greene, *Protective Groups in Organic Synthesis*, John Wiley & Sons (1981), and J. F. W. McOmie, *Protective Groups in Organic Chemistry*, Plenum Press (1973), as well as methods as described in the above references.

Furthermore, the AB block copolymer can be also synthesized by a photoiniferter polymerization method using a dithiocarbamate compound as an initiator. For example, the block copolymer can be synthesized according to synthesis methods as described, e.g., in Takayuki Otsu, *Kobunshi* (*Polymer*), 37, 248 (1988), Shunichi Himori and Ryuichi Ohtsu, *Polym. Rep. Jap.*, 37, 508 (1988), JP-A-64-111, and JP-A-64-26619.

The macromonomer (M) according to the present invention can be obtained by applying the above described synthesis method for macromonomer to the AB block copolymer.

Specific examples of the macromonomer (M) which can be used in the present invention are set forth below, but the present invention should not be construed as being limited thereto. In the following formulae, c, d and e each represents —H, —$CH_3$ or —$CH_2COOCH_3$; f represents —H or —$CH_3$; $R_{11}$ represents —$C_pH_{2p+1}$ (wherein p represents an integer of from 1 to 18),

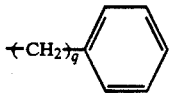

(wherein q represents an integer of from 1 to 3),

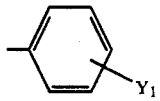

(wherein $Y_1$ represents —H, —Cl, —Br, —$CH_3$, —$OCH_3$ or —$COCH_3$) or

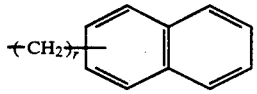

(wherein r represents an integer of from 0 to 3); $R_{12}$ represents —$C_sH_{2s+1}$ (wherein s represents an integer of from 1 to 8) or

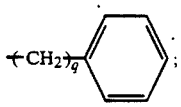

$Y_2$ represents —OH, —COOH, —$SO_3H$,

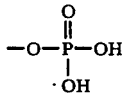

or

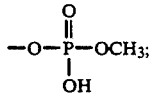

$Y_2$ represents —COOH, —$SO_3H$,

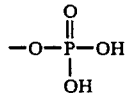

or

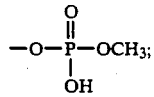

t represents an integer of from 2 to 12; and u represents an integer of from 2 to 6.

(M-1)

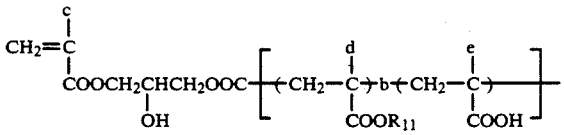

(M-2)

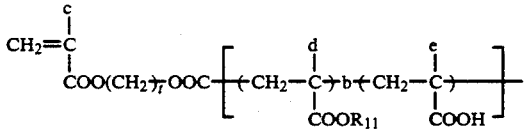

(M-3)

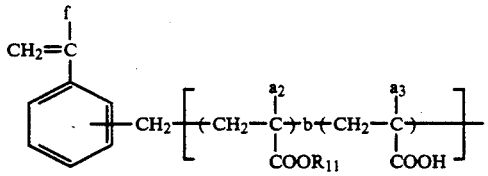

(M-4)

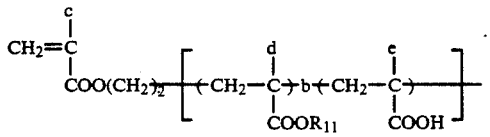

-continued
(M-5)
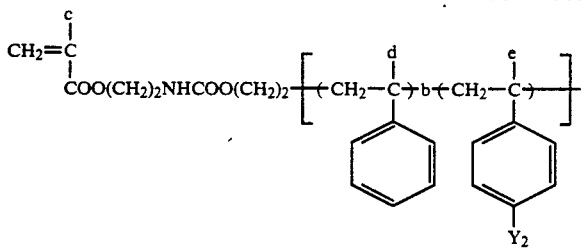
(M-6)
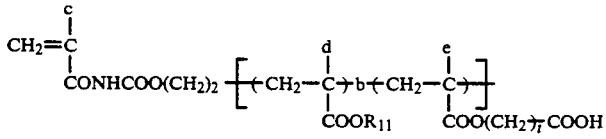
(M-7)
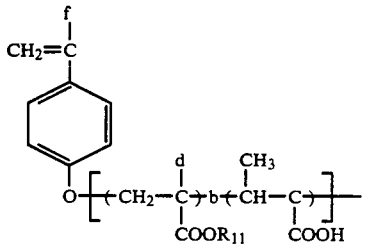
(M-8)
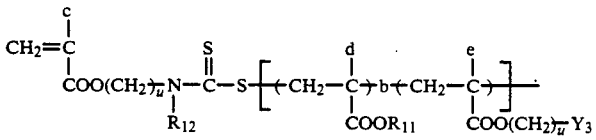
(M-9)
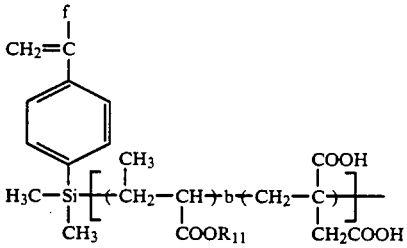
(M-10)
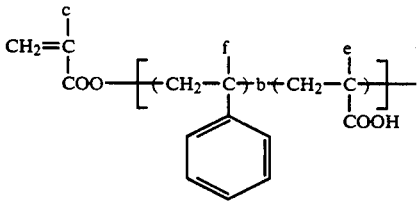
(M-11)
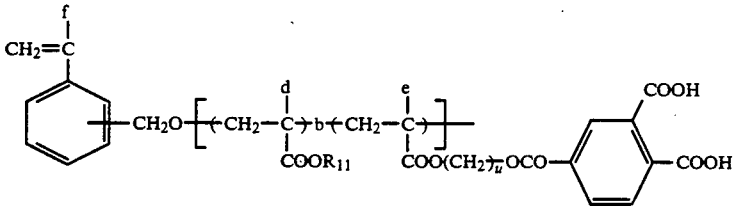
(M-12)
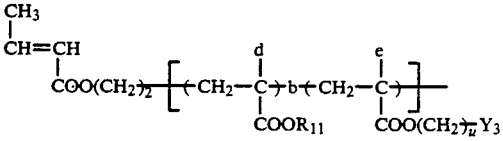

-continued (M-13)

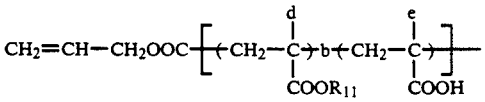

(M-14)

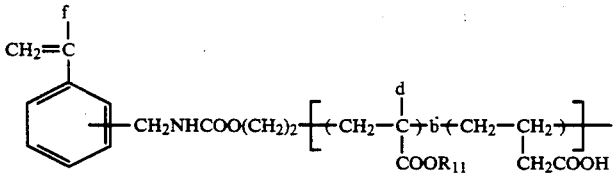

(M-15)

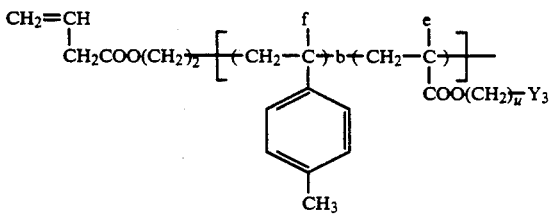

(M-16)

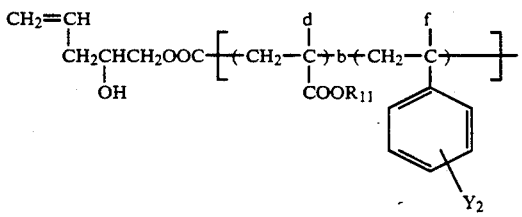

The monomer copolymerizable with the macromonomer (M) described above is preferably selected from those represented by the general formula (II). In the general formula (II), $R_2$ has the same meaning as defined for $R_1$ in the general formula (I) as described above.

As described above, the resin (A) of a low molecular weight according to the present invention preferably is formed from, as a copolymerizable component, a methacrylate component having a specific substituent containing a benzene ring which has a specific substituent(s) at the 2-position or 2- and 6-positions thereof or a specific substituent containing an unsubstituted naphthalene ring represented by the general formula (IIa) or (IIb).

In the general formula (IIa), $X_1$ and $X_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), or $—COZ_3$ or $—COOZ_3$, wherein $Z_3$ preferably represents any of the above-recited hydrocarbon groups.

In the general formula (IIa), $L_1$ is a mere bond or a linkage group containing from 1 to 4 linking atoms which connects between —COO— and the benzene ring, e.g., $-(CH_2)_{m1}$ (wherein $m_1$ represents an integer of 1, 2 or 3, $—CH_2CH_2OCO—$, $-(CH_2O)_{m2}$ (wherein $m_2$ represents an integer of 1 or 2, and $—CH_2CH_2O—$.

In the general formula (IIb), $L_2$ has the same meaning as $L_1$ in the general formula (IIa).

Specific examples of monomer represented by the general formula (IIa) or (IIb) which are used in the resin (A') according to the present invention are set forth below, but the present invention is not to be construed as being limited thereto.

II-1)

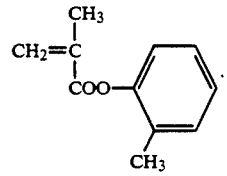

II-2)

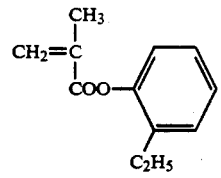

II-3)

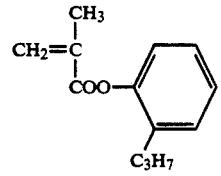

II-4)

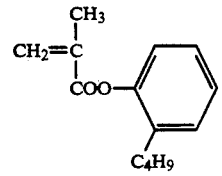

-continued
II-5)
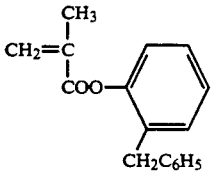
II-6)
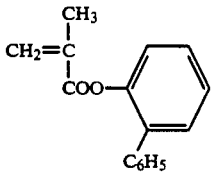
II-7)
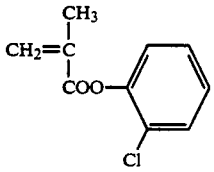
II-8)
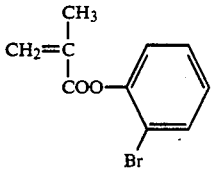
II-9)
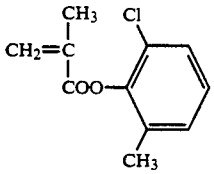
II-10)
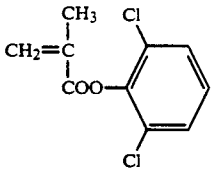
II-11)
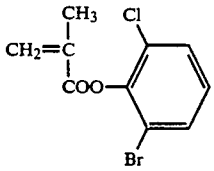
II-12)
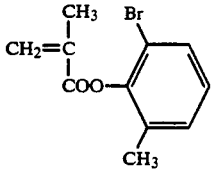
II-13)
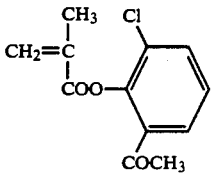
-continued
II-14)
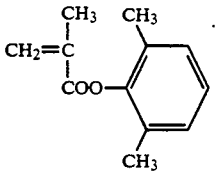
II-15)
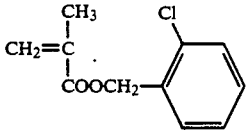
II-16)
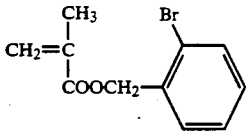
II-17)
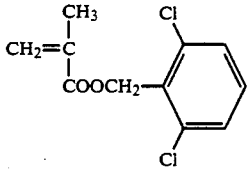
II-18)
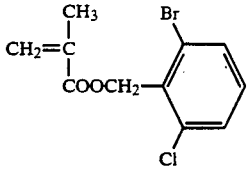
II-19)
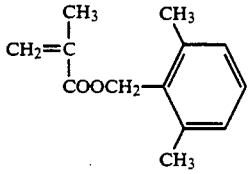
II-20)
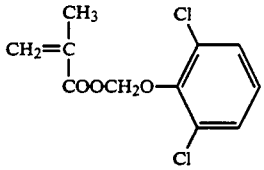
II-21)
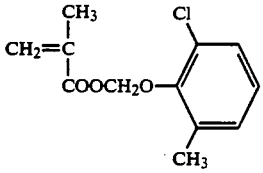
II-22)
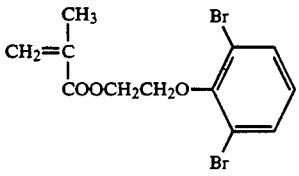

-continued
II-23)
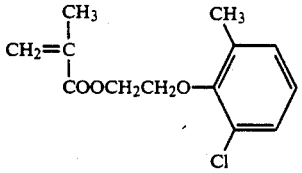
II-24)
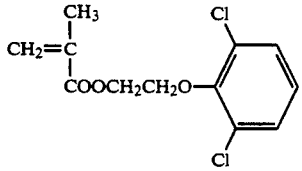
II-25)
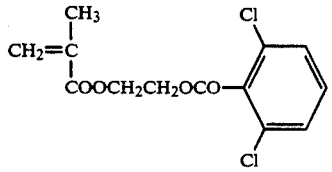
II-26)
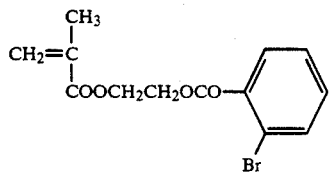
II-27)
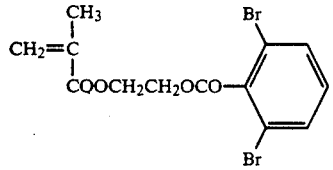
II-28)
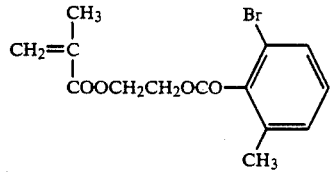
II-29)
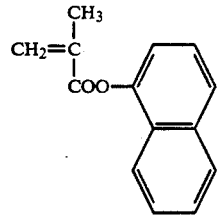
II-30)
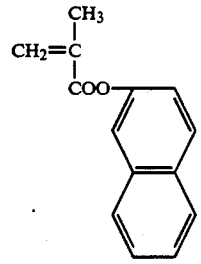
-continued
II-31)
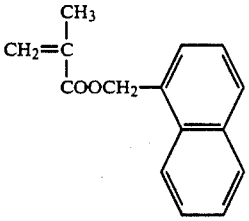
II-32)
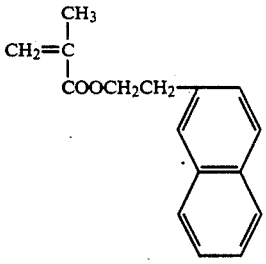
II-33)
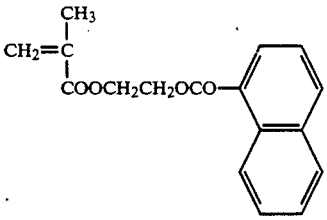
II-34)
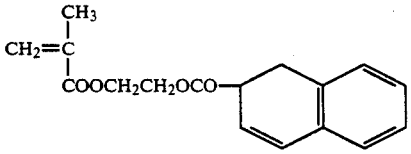
II-35)
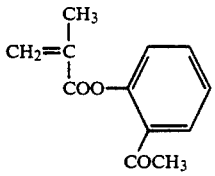
II-36)
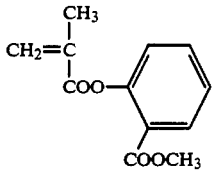
II-37)
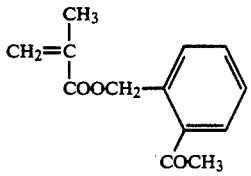
II-38)
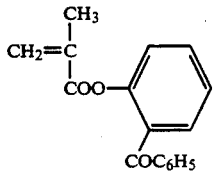

-continued

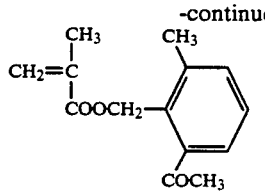

II-39)

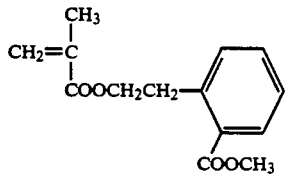

II-40)

Monomers other than those represented by the general formula (II) (including those represented by the general formula (IIa) or (IIb)) may be employed as a component copolymerizable with the macromonomer (M) in the graft type copolymer according to the present invention. Examples of such monomers include, α-olefins, vinyl or allyl esters of alkanoic acids, acrylonitrile, methacrylonitrile, vinyl ethers, acrylamides, methacrylamides, styrenes, and heterocyclic vinyl compounds (for example, those containing a 5-membered to 7-membered heterocyclic ring containing from 1 to 3 non-metallic atoms other than a nitrogen atom (e.g., oxygen, and sulfur), specifically including vinylthiophene, vinyldioxane, and vinylfuran). Preferred examples thereof include vinyl or allyl esters of alkanoic acid having from 1 to 3 carbon atoms, acrylonitrile, methacrylonitrile, styrene and styrene derivatives (e.g., vinyltoluene, butylstyrene, methoxystyrene, chlorostyrene, dichlorostyrene, bromostyrene, and ethoxystyrene).

The resin (A) according to the present invention can be produced by copolymerization of at least one compound each selected from the macromonomers (M) and other monomers (for example, those represented by the general formula (II)) in the desired ratio. The copolymerization can be performed using a known polymerization method, for example, solution polymerization, suspension polymerization, precipitation polymerization, and emulsion polymerization. More specifically, according to the solution polymerization monomers are added to a solvent such as benzene or toluene in the desired ratio and polymerized with an azobis compound, a peroxide compound or a radical polymerization initiator to prepare a copolymer solution. The solution is dried or added to a poor solvent whereby the desired copolymer can be obtained. In case of suspension polymerization, monomers are suspended in the presence of a dispersing agent such as polyvinyl alcohol or polyvinyl pyrrolidone and copolymerized with a radical polymerization initiator to obtain the desired copolymer.

In the resin (A), the content of the polymer component having the specific acidic group present in the macromonomer (M) is from 1 to 20 parts by weight and preferably from 3 to 15 parts by weight per 100 parts by weight of the resin (A).

The weight average molecular weight of the resin (A) is preferably from $3\times10^3$ to $1\times10^4$.

Now, the resin (B) used in the present invention will be described below in greater detail.

The resin (B) is a resin containing at least one repeating unit represented by the general formula (III), having a partially crosslinked structure, and having a weight average molecular weight of $5\times10^4$ or more, and preferably from $8\times10^4$ to $6\times10^5$.

The resin (B) preferably has a glass transition point ranging from 0° C. to 120° C., and more preferably from 10° C. to 95° C.

If the weight average molecular weight of the resin (B) is less than $5\times10^4$, the effect of improving film strength is insufficient. If it exceeds the above-described preferred upper limit, on the other hand, the resin (B) has no substantial solubility in organic solvents and thus may not be practically used.

The resin (B) is a polymer satisfying the above-described physical properties with a part thereof being crosslinked, and including a homopolymer comprising the repeating unit represented by the general formula (III) or a copolymer comprising the repeating unit of the general formula (III) and other monomer copolymerizable with the monomer corresponding to the repeating unit of the general formula (III).

In the repeating unit of the general formula (III), the hydrocarbon groups may be substituted.

$V_3$ in the general formula (III) preferably represents —COO—, —OCO—, —$CH_2$OCO—, —$CH_2$COO—, or —O—, and more preferably —COO—, —$CH_2$COO—, or —O—.

$R_3$ in the general formula (III) preferably represents a substituted or unsubstituted hydrocarbon group having from 1 to 18 carbon atoms. The substituent may be any of substituents other than the above-described polar groups which may be bonded to the one terminal of the polymer main chain. Examples of such substituents include a halogen atom (e.g., fluorine, chlorine, and bromine), —O—$Z_4$, —COO—$Z_4$, and —OCO—$Z_4$, wherein $Z_4$ represents an alkyl group having from 6 to 22 carbon atoms (e.g., hexyl, octyl, decyl, dodecyl, hexadecyl, and octadecyl). Specific examples of preferred hydrocarbon groups are a substituted or unsubstituted alkyl group having from 1 to 18 carbon atoms (e.g., methyl, ethyl, propyl, butyl, pentyl, hexyl heptyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), a substituted or unsubstituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), a substituted or unsubstituted alicyclic group having from 5 to 8 carbon atom (e.g., cyclohexyl, 2-cyclohexylethyl, and 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

In the general formula (III), $d_1$ and $d_2$, which may be the same or different, each preferably represents a hydrogen atom, a halogen atom (e.g., fluorine, chlorine, and bromine), a cyano group, an alkyl group having from 1 to 3 carbon atoms, —COO—$Z_3$, —CH- $_2COO—Z_3$, wherein $Z_3$ preferably represents an aliphatic group having from 1 to 18 carbon atoms. More preferably, $d_1$ and $d_2$, which may be the same or different, each represents a hydrogen atom, an alkyl group having from 1 to 3 carbon atoms (e.g., methyl, ethyl, and propyl), —COO—$Z_3$, —$CH_2COO$—$Z_3$, wherein $Z_3$ more preferably represents an alkyl group having from 1 to 18 carbon atoms or an alkenyl group having from 3 to 18 carbon atoms (e.g., methyl, ethyl, propyl, butyl, hexyl, octyl, decyl, dodecyl, tridecyl, tetradecyl, hexadecyl, octadecyl, pentenyl, hexenyl, octenyl, and decenyl). These alkyl or alkenyl groups may be substituted with one or more substituents same as those described with respect to $R_3$.

In the production of the resin (B), introduction of a crosslinked structure into the polymer can be achieved by known techniques, for example, a method of conducting polymerization of monomers including the monomer corresponding to the repeating unit of the general formula (III) in the presence of a polyfunctional monomer and a method of preparing a polymer containing a crosslinking functional group and conducting a crosslinking reaction through a macromolecular reaction.

From the standpoint of ease and convenience of procedure, that is, considered that there are involved no unfavorable problems such that a long time is required for the reaction, the reaction is not quantitative, or impurities arising from a reaction accelerator are incorporated into the product, it is preferable to synthesize the resin (B) by using a self-crosslinkable functional group: —$CONHCH_2OR_{31}$ (wherein $R_{31}$ represents a hydrogen atom or an alkyl group) or by utilizing crosslinking through polymerization.

Where a polymerizable reactive group is used, it is preferable to copolymerize a monomer containing two or more polymerizable functional groups and the monomer corresponding to the general formula (III) to thereby form a crosslinked structure over polymer chains.

Specific examples of suitable polymerizable functional groups include $CH_2$=CH—, $CH_2$=CH—$CH_2$—,

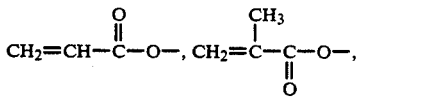

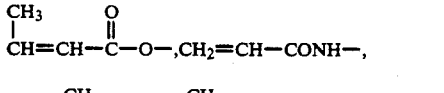

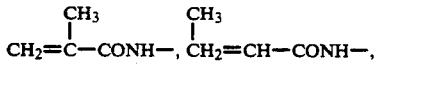

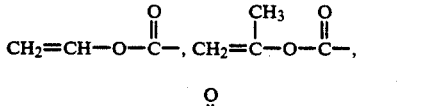

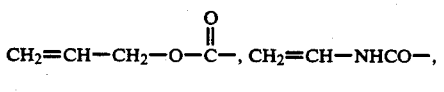

$CH_2$=CH—$CH_2$—O—C(=O)—, $CH_2$=CH—NHCO—, $CH_2$=CH—$CH_2$—NHCO—, $CH_2$=CH—$SO_2$—, $CH_2$=CH—CO—, $CH_2$=CH—O—, and $CH_2$=CH—S—.

The two or more polymerizable functional groups in the monomer may be the same or different.

Specific examples of the monomer having two or more same polymerizable functional groups include styrene derivatives (e.g., divinylbenzene and trivinylbenzene); esters of a polyhydric alcohol (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or a polyhydroxyphenol (e.g., hydroquinone, resorcin, catechol, and derivatives thereof) and methacrylic acid, acrylic acid or crotonic acid; vinyl ethers, allyl ethers; vinyl esters, allyl esters, vinylamides or allylamides of a dibasic acid (e.g., malonic acid, succinic acid, glutaric acid, adipic acid, pimelic acid, maleic acid, phthalic acid, and itaconic acid); and condensates of a polyamine (e.g., ethylenediamine, 1,3-propylenediamine, and 1,4-butylenediamine) and a carboxylic acid having a vinyl group (e.g., methacrylic acid, acrylic acid, crotonic acid, and allylacetic acid).

Specific examples of the monomer having two or more different polymerizable functional groups include vinyl-containing ester derivatives or amide derivatives of a vinyl-containing carboxylic acid (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a reaction product of a carboxylic acid anhydride and an alcohol or an amine (e.g., allyloxycarbonylpropionic acid, allyloxycarbonylacetic acid, 2-allyloxycarbonylbenzoic acid, and allylaminocarbonylpropionic acid)) (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethyl acrylate, N-allylacrylamide, N-allylmethacrylamide, N-allylitaconic acid amide, and methacryloylpropionic acid allylamide), and condensates of an amino alcohol (e.g., aminoethanol, 1-aminopropanol, 1-aminobutanol, 1-aminohexanol, and 2-aminobutanol) and a vinyl-containing carboxylic acid.

The resin (B) having a partially crosslinked structure can be obtained by polymerization using the above-described monomer having two or more polymerizable functional groups in a proportion of not more than 20% by weight based on the total monomers. It is more preferable for the monomer having two or more polymerizable functional groups to be used in a proportion of not more than 15% by weight in cases where the polar group is introduced into the terminal by using a chain transfer agent hereinafter described, or in a proportion of not more than 5% by weight in other cases.

On the other hand, where the resin (B) contains no polar group at the terminal thereof (i.e., the resin (B) other than the resin (B')), a crosslinked structure may be formed in the resin (B) by using a resin containing a crosslinking functional group which undergoes curing on application of heat and/or light.

Such a crosslinking functional group may be any of those capable of undergoing a chemical reaction between molecules to form a chemical bond. Specifically, a mode of reaction inducing intermolecular bonding by a condensation reaction or addition reaction, or crosslinking by a polymerization reaction upon application of heat and/or light can be utilized.

Examples of the above-described crosslinking functional group include (i) at least one combination of (i-1) a functional group having a dissociative hydrogen atom {e.g., —COOH, —$PO_3H_2$,

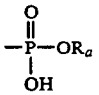

(wherein $R_a$ represents an alkyl group having from 1 to 18 carbon atoms (preferably an alkyl group having from 1 to 6 carbon atoms (e.g., methyl, ethyl, propyl, butyl, and hexyl)), an aralkyl group having from 7 to 11 carbon atoms (e.g., benzyl, phenethyl, methylbenzyl, chlorobenzyl, and methoxybenzyl), an aryl group having from 6 to 12 carbon atoms (e.g., phenyl, tolyl, xylyl, mesityl, chlorophenyl, ethylphenyl, methoxyphenyl, and naphthyl), —$OR_{32}$ (wherein $R_{32}$ has the same meaning as the above-described hydrocarbon group for $R_a$), —OH, —SH, and —$NHR_{33}$ (wherein $R_{33}$ represents a hydrogen atom or an alkyl group having from 1 to 4 carbon atoms, e.g., methyl, ethyl, propyl, and butyl)} and (i-2) a functional group selected from the group consisting of

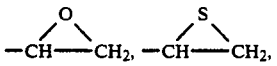

—NCO, and —NCS; and (ii) a group containing —$CONHCH_2OR_{34}$ (wherein $R_{34}$ represents a hydrogen atom or an alkyl group having from 1 to 6 carbon atoms, e.g., methyl, ethyl, propyl, butyl, and hexyl) or a polymerizable double bond group.

Specific examples of the polymerizable double bond group are the same as those described above for the polymerizable functional groups.

Further, specific examples of the functional groups and compounds to be used are described, e.g., in Tsuyoshi Endo, *Netsukokasei Kobunshi no Seimitsuka,* C.M.C. K.K. (1986), Yuji Harasaki, *Saishin Binder Gijutsu Binran,* Ch. II-1, Sogo Gijutsu Center (1985), Takayuki Ohtsu, *Acryl Jushi no Gosei Sekkei to Shin Yoto Kaihatsu,* Chubu Keiei Kaihatsu Center Shuppanbu (1985), Eizo Ohmori, *Kinosei Acryl Jushi,* Techno System (1985), Hideo Inui and Gentaro Nagamatsu, *Kankosei Kobunshi,* Kodansha (1977), Takahiro Kadota, *Shin Kankosei Jushi,* Insatsu Gakkai Shuppanbu (1981), G. E. Green and B. P. Stark, *J. Macro. Sci. Revs. Macro. Chem.,* C21(2), pp. 187–273 (1981–1982), and C. G. Roffey, *Photopolymerization of Surface Coatings,* A. Wiley Interscience Pub. (1982).

These crosslinking functional groups may be present in the same copolymerizable component or separately in different copolymerizable components.

Suitable monomers corresponding to the copolymerizable components containing the crosslinking functional group include vinyl compounds containing such a functional group and being capable of copolymerizable with the monomer corresponding to the general formula (III). Examples of such vinyl compounds are described, e.g., in Kobunshi Gakkai (ed.), Kobunshi Data Handbook (*Kiso-hen*), Baifukan (1986). Specific examples of these vinyl monomers include acrylic acid, α- and/or β-substituted acrylic acids (e.g., α-acetoxy, α-acetoxymethyl, α-(2-amino)ethyl, α-chloro, α-bromo, α-fluoro, α-tributylsilyl, α-cyano, β-chloro, β-bromo, α-chloro-β-methoxy, and α,β-dichloro compounds)), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half ester derivatives of dicarboxylic acids, and ester or amide derivatives of these carboxylic acids or sulfonic acids containing the crosslinking functional group in the substituents thereof.

The proportion of the above-described copolymerizable component containing the crosslinking functional group in the resin (B) preferably ranges from 0.05 to 30% by weight, and more preferably from 0.1 to 20% by weight.

In the preparation of such a resin, a reaction accelerator may be used, if desired, to accelerate a crosslinking reaction. Examples of usable reaction accelerators include acids (e.g., acetic acid, propionic acid, butyric acid, benzenesulfonic acid, and p-toluenesulfonic acid), peroxides, azobis compounds, crosslinking agents, sensitizers, and photopolymerizable monomers. Specific examples of crosslinking agents are described, for example, in Shinzo Yamashita and Tosuke Kaneko (ed.), *Kakyozai Handbook,* Taiseisha (1981), including commonly employed crosslinking agents such as organosilanes, polyurethanes and polyisocyanates, and curing agents such as epoxy resins and melamine resins.

Where the resin contains a photo-crosslinking functional group, compounds described in the literature cited above with respect to photosensitive resins can be used.

The resin (B) may further contain, as copolymerizable component, other monomers (e.g., those described above as optional monomers which may be present in the resin (A)), in addition to the monomer corresponding to the repeating unit of the general formula (III) and the above-described polyfunctional monomer.

While the resin (B) is characterized by having its partial crosslinked structure as stated above, it is also required to be soluble in an organic solvent used at the preparation of a dispersion for forming a photoconductive layer containing at least an inorganic photoconductive substance and the binder resin. More specifically, it is required that at least 5 parts by weight of the resin (B) be dissolved in 100 parts by weight of toluene at 25° C. Solvents which can be used in the preparation of the dispersion include halogenated hydrocarbons, e.g., dichloromethane, dichloroethane, chloroform, methylchloroform, and triclene; alcohols, e.g., methanol, ethanol, propanol, and butanol; ketones, e.g., acetone, methyl ethyl ketone, and cyclohexanone; ethers, e.g., tetrahydrofuran, and dioxane; esters, e.g., methyl acetate, ethyl acetate, propyl acetate, butyl acetate, and methyl propionate; glycol ethers, e.g., ethylene glycol monomethyl ether, and 2-methoxyethylacetate; and aromatic hydrocarbons, e.g., benzene, toluene, xylene, and chlorobenzene. These solvents may be used either individually or as a mixture thereof.

According to a preferred embodiment of the resin (B), the resin (B) is a polymer (the resin (B')) having a weight average molecular weight of $5\times10^4$ or more, and preferably between $8\times10^4$ and $6\times10^5$, containing at least one repeating unit represented by the general formula (III), having a partially crosslinked structure and, in addition, having at least one polar group selected from $-PO_3H_2$, $-SO_3H$, $-COOH$, $-OH$, $-SH$,

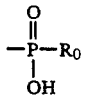

(wherein $R_0$ represents a hydrocarbon group or $-OR_0'$, wherein $R_0'$ represents a hydrocarbon group), a cyclic acid anhydride-containing group, $-CHO$, $-CONH_2$, $-SO_2NH_2$, and

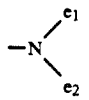

(wherein $e_1$ and $e_2$, which may be the same or different, each represents a hydrogen atom or a hydrocarbon group) bonded to only one terminal of at least one main chain thereof.

The resin (B') preferably has a glass transition point of from 0° C. to 120° C., and more preferably from 10° C. to 95° C.

The —OH group includes a hydroxy group of alcohols containing a vinyl group or an allyl group (e.g., allyl alcohol), a hydroxy group of (meth)acrylates containing —OH group in an ester substituent thereof, a hydroxy group of (meth)acrylamides containing —OH group in an N-substituent thereof, a hydroxy group of hydroxy-substituted aromatic compounds containing a polymerizable double bond, and a hydroxy group of (meth)acrylic acid esters and amides each having a hydroxyphenyl group as a substituent.

The $PO_2R_0H$ and cyclic anhydride-containing group each of which is present in the resin (B') are the same as those described with respect to the resin (A) above.

In the polar group

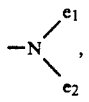

specific examples of $e_1$ and $e_2$ include a hydrogen atom, a substituted or unsubstituted aliphatic group having from 1 to 1 carbon atoms (e.g., methyl, ethyl, propyl, butyl, hexyl, octyl, 2-cyanoethyl, 2-chloroethyl, 2-ethoxycarbonylethyl, benzyl, phenethyl, and chlorobenzyl), and a substituted or unsubstituted aryl group (e.g., phenyl tolyl, xylyl, chlorophenyl, bromophenyl methoxycarbonylphenyl, and cyanophenyl).

Of the terminal polar groups in the resin (B'), preferred are $-PO_3H_3$, $-SO_3H$, $-COOH$, $-OH$, $-SH$,

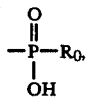

$-CONH_2$, and $-SO_2NH_2$.

In the resin (B'), the specific polar group is bonded to one terminal of the polymer main chain either directly or via an appropriate linking group. The linking group includes a carbon-carbon bond (single bond or double bond), a carbon-hetero atom bond (the hetero atom including e.g., an oxygen atom, a sulfur atom, a nitrogen atom, and a silicon atom), a hetero atom-hetero atom bond, or an appropriate combination thereof.

Specific examples of linking group include

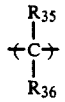

(wherein $R_{35}$ and $R_{36}$ each represents a hydrogen atom, a halogen atom (e.g., fluorine, chlorine, and bromine), a cyano group, a hydroxyl group, an alkyl group (e.g., methyl, ethyl, and propyl)), $\text{+CH=CH+}$,

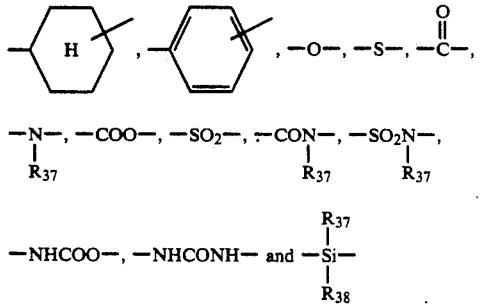

(wherein $R_{37}$ and $R_{38}$ each represents a hydrogen atom or a hydrocarbon group having from 1 to 8 carbon atoms (e.g., methyl, ethyl, propyl, butyl pentyl, hexyl, benzyl, phenethyl, phenyl, and tolyl) or $-OR_{39}$ (wherein $R_{39}$ has the same meaning as the hydrocarbon group for $R_{37}$).

The resin (B') having the specific polar group bonded to only one terminal of at least one polymer main chain thereof can be easily synthesized by a method comprising reacting various reagents on the terminal of a living polymer obtained by conventional anion polymerization or cation polymerization (ion polymerization method), a method comprising radical polymerization using a polymerization initiator and/or chain transfer agent containing the specific polar group in its molecule (radical polymerization method), or a method comprising once preparing a polymer having a reactive group at the terminal thereof by the above-described ion polymerization method or radical polymerization method and converting the terminal reactive group into the specific polar group by a macromolecular reaction. For details, reference can be made, for example, to P. Dreyfuss and R. P. Quirk *Encycl. Polym. Sci. Eng,* 7, 551 (1987), Yoshiki Nakajo and Yuya Yamashita, *Senryo to Yakuhin,* 30, 232 (1985), and Akira Ueda and Susumu Nagai, *Kagaku to Kogyo,* 60, 57 (1986), and literature references cited therein.

In greater detail, the resin (B') can be prepared by a method in which a mixture of a monomer corresponding to the repeating unit represented by the general formula (III), the above described polyfunctional monomer for forming a crosslinked structure, and a chain transfer agent containing the specific polar group to be introduced to one terminal is polymerized in the presence of a polymerization initiator (e.g., azobis compounds and peroxides), a method using a polymerization initiator containing the specific polar group to be introduced without using the above described chain transfer agent, or a method using a chain transfer agent and a polymerization initiator both of which contain the specific polar group to be introduced. Further, the resin (B') may also be obtained by conducting polymerization using a compound having a functional group, such as an amino group, a halogen atom, an epoxy group, or an acid halide group, as the chain transfer agent or polymerization initiator according to any of the three methods set forth above, followed by reacting such a functional group through a macromolecular reaction to thereby introduce the polar group into the resulting polymer. Suitable examples of chain transfer agents used include mercapto compounds containing the polar group or a substituent capable of being converted to the polar group, e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-mercaptoethyl)amino]propionic acid, N-(3-mercaptopropionyl)-alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol; and iodoalkyl compounds containing the polar group or a substituent capable of being converted to the polar group, e.g., iodoacetic acid, iodopropionic acid, 2-iodoethanol, 2-iodoethanesulfonic acid, and 3-iodopropanesulfonic acid. Preferred of them are mercapto compounds.

The chain transfer agent or polymerization initiator is used in an amount of from 0.5 to 15 parts by weight, and preferably from 1 to 10 parts by weight, per 100 pats by weight of the total monomers.

The ratio of the resin (A) (including the resin (A')) to the amount of the resin (B) (including the resin (B')) used in the present invention varies depending on the kind, particle size, and surface conditions of the inorganic photoconductive substance used. In general, however, the weight ratio of the resin (A)/the resin (B) is 5 to 60/95 to 40, preferably 10 to 50/90 to 50.

In addition to the resin (A) (including the resin (A')) and the resin (B) (including the resin (B'), the resin binder according to the present invention may further comprise other resins. Suitable examples of such resins include alkyd resins, polybutyral resins, polyolefins, ethylene-vinyl acetate copolymers, styrene resins, styrene-butadiene resins, acrylate-butadiene resins, and vinyl alkanoate resins.

The proportion of these other resins should not exceed 30% by weight based on the total binder. If the proportion exceeds 30% by weight, the effects of the present invention, particularly the improvement in electrostatic characteristics, would be lost.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide and titanium oxide.

The binder resin is used in a total amount of from 10 to 100 parts by weight, preferably from 15 to 50 parts by weight, per 100 parts by weight of the inorganic photoconductive substance.

If desired, various dyes can be used as spectral sensitizers in the present invention. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging*, 1973, No. 8, 12, C. J. Young et al., *RCA Review*, 15, 469 (1954), Kohei Kiyota et al., *Denkitsushin Gakkai Ronbunshi*, J 63-C, No. 2, 97 (1980), Yuji Harasaki et al., *Kogyo Kagaku Zasshi*, 66, 78 and 188 (1963), and Tadaaki Tani, *Nihon Shashin Gakkaishi*, 35, 208 (1972).

Specific examples of the carbonium dyes, triphenylmethane dyes, xanthene dyes, and phthalein dyes are described, for example, in JP-B-51-452, JP-A-50-334, JP-A-50-114227, JP-A-53-39130, JP-A-53-82353, U.S. Pat. Nos. 3,052,540 and 4,054,450, and JP-A-57-16456.

The polymethine dyes such as oxonol dyes, merocyanine dyes, cyanine dyes and rhodacyanine dyes include those described, for example, in F. M. Hamer, *The Cyanine Dyes and Related Compounds*. Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-5141, JP-A-57-157254, JP-A-61-26044, JP-A-61-27551, U.S. Pat. Nos. 3,619,154 and 4,175,956, and *Research Disclosure*, 216, 117 to 118 (1982).

The light-sensitive material of the present invention is particularly excellent in that the performance properties are not liable to vary even when combined with various kinds of sensitizing dyes.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging*, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka*, Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylic resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin,* 14, No. 1, 2 to 11 (1975), Hiroyuki Moriga, *Nyumon Tokushushi no Kagaku,* Kobunshi Kankokai (1975), and M. F. Hoover, *J, Macromol. Sci. Chem.,* A-4(6), 1327 to 1417 (1970).

In accordance with the present invention, an electrophotographic light-sensitive material which exhibits excellent electrostatic characteristics and mechanical strength even under severe conditions, and provides clear images of good quality can be obtained. The electrophotographic light-sensitive material according to the present invention is suitable for producing a lithographic printing plate. It is also advantageously employed in the scanning exposure system using a semiconductor laser beam.

The present invention will now be illustrated in greater detail with reference to the following examples, but it should be understood that the present invention is not to be construed as being limited thereto.

SYNTHESIS EXAMPLE M-1

Synthesis of Macromonomer (M-1)

A mixed solution of 30 g of triphenylmethyl methacrylate, and 100 g of toluene was sufficiently degassed under nitrogen gas stream and cooled to −20° C. Then, 1.0 g of 1,1-diphenylbutyl lithium was added to the mixture, and the reaction was conducted for 10 hours. Separately, a mixed solution of 70 g of ethyl methacrylate and 100 g of toluene was sufficiently degassed under nitrogen gas stream and the resulting mixed solution was added to the above described mixture, and then reaction was further conducted for 10 hours. The reaction mixture was adjusted to 0° C., and carbon dioxide gas was passed through the mixture in a flow rate of 60 ml/min for 30 minutes, then the polymerization reaction was terminated.

The temperature of the reaction solution obtained was raised to 25° C. under stirring, 6 g of 2-hydroxyethyl methacrylate was added thereto, then a mixed solution of 12 g of dicyclohexylcarbodiimide, 1.0 g of 4-N,N-dimethylaminopyridine and 20 g of methylene chloride was added dropwise thereto over a period of 30 minutes, and the mixture was stirred for 3 hours.

After removing the insoluble substances from the reaction mixture by filtration, 10 ml of an ethanol solution of 30% by weight hydrogen chloride was added to the filtrate and the mixture was stirred for one hour. Then, the solvent of the reaction mixture was distilled off under reduced pressure until the whole volume was reduced to a half, and the mixture was reprecipitated from one liter of petroleum ether.

The precipitates thus formed were collected and dried under reduced pressure to obtain 56 g of Macromonomer (M-1) shown below having a weight average molecular weight (hereinafter simply referred to as Mw) of $6.5\times10^3$.

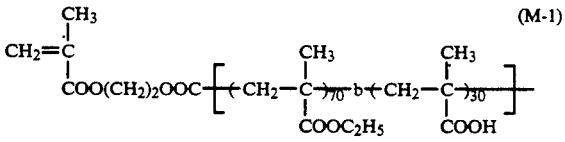

SYNTHESIS EXAMPLE M-2

Synthesis of Macromonomer (M-2)

A mixed solution of 5 g of benzyl methacrylate, 0.1 g of (tetraphenyl porphynate) aluminum methyl, and 60 g of methylene chloride was raised to a temperature of 30° C. under nitrogen gas stream. The mixture was irradiated with light from a xenon lamp of 300 W at a distance of 25 cm through a glass filter to conduct a reaction for 12 hours. To the mixture was further added 45 g of butyl methacrylate, after similarly light-irradiating for 8 hours, 10 g of 4-bromomethylstyrene was added to the reaction mixture followed by stirring for 30 minutes, then the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of petroleum ether and the precipitates thus formed were collected and dried to obtain 33 g of Macromonomer (M-2) shown below having an Mw of $7\times10^3$.

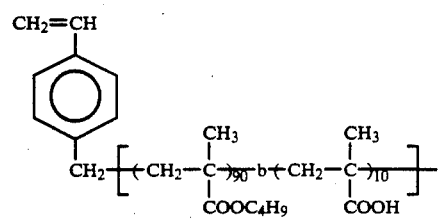

SYNTHESIS EXAMPLE M-3

Synthesis of Macromonomer (M-3)

A mixed solution of 20 g of 4-vinylphenyloxytrimethylsilane and 100 g of toluene was sufficiently degassed under nitrogen gas stream and cooled to 0° C. Then, 2g of 1,1-dephenyl-3-methylpentyl lithium was added to the mixture followed by stirring for 6 hours. Separately, a mixed solution of 80 g of 2-chloro-6-methylphenyl methacrylate and 100 g of toluene was sufficiently degassed under nitrogen gas stream and the resulting mixing solution was added to the above described mixture, and then reaction was further conducted for 8 hours. After introducing ethylene oxide in a flow rate of 30 ml/min into the reaction mixture for 30 minutes with vigorously stirring, the mixture was cooled to a temperature of 15° C., and 12 g of methacrylic chloride was added dropwise thereto over a period of 30 minutes, followed by stirring for 3 hours.

Then, to the reaction mixture was added 10 ml of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of Macromonomer (M-3) shown below having an Mw of $7.8\times10^3$.

(M-3)

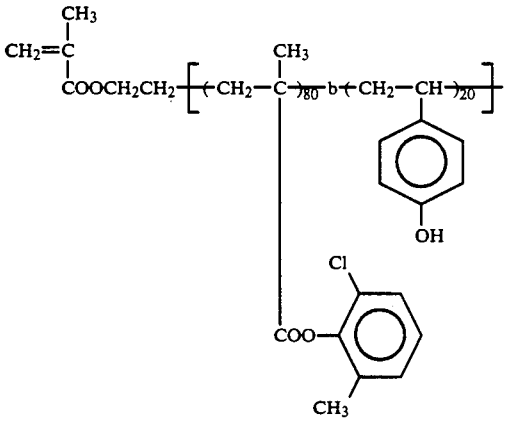

the reaction was conducted for one hour, followed by reacting at 25° C. for 2 hours.

Then, to the reaction mixture was added 10 ml of an ethanol solution of 30% by weight hydrogen chloride, followed by stirring for 2 hours. After removing the insoluble substances from the reaction mixture by filtration, the mixture was reprecipitated from one liter of n-hexane. The precipitates thus formed were collected and dried under reduced pressure to obtain 58 g of Macromonomer (M-4) shown below having an Mw of $4.5\times10^3$.

(M-4)

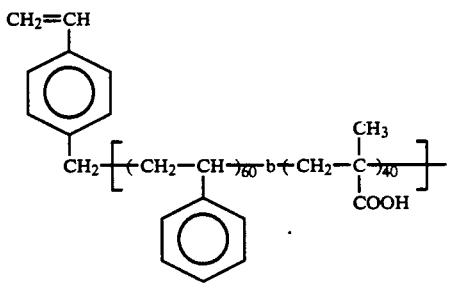

SYNTHESIS EXAMPLE M-5

Synthesis of Macromonomer (M-5)

A mixed solution of 70 g of phenyl methacrylate and 4.8 g of benzyl N-hydroxyethyl-N-ethyldithiocarbamate was placed in a vessel under nitrogen gas stream followed by closing vessel and heated to 60° C. The mixture was irradiated with light from a high-pressure mercury lamp for 400 W at a distance of 10 cm through a glass filter for 10 hours to conduct a photopolymerization.

Then, 30 g of acrylic acid and 180 g of methyl ethyl ketone were added to the mixture and, after replacing the gas in the vessel with nitrogen, the mixture was light-irradiated again for 10 hours.

To the reaction mixture was added dropwise 12 g of 2-isocyanatoethyl methacrylate at 30° C. over a period of one hour and the mixture was stirred for 2 hours. The reaction mixture was reprecipitated form 1.5 liters of hexane, and the precipitates thus formed were collected and dried to obtain 68 g of Macromonomer (M-5) shown below having an Mw of $6.0\times10^3$.

(M-5)

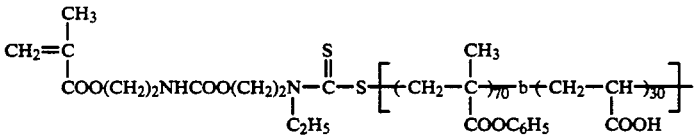

SYNTHESIS EXAMPLE M-4

Synthesis of Macromonomer (M-4)

A mixed solution of 40 g of triphenylmethyl acrylate and 100 g of toluene was sufficiently degassed under nitrogen gas stream and cooled to −20° C. Then, 2 g of sec-butyl lithium was added to the mixture, and the reaction was conducted for 10 hours. Separately, a mixed solution of 60 g of styrene and 100 g of toluene was sufficiently degassed under nitrogen gas stream and the resulting mixed solution was added to the above described mixture, and then reaction was further conducted for 12 hours. The reaction mixture was adjusted to 0° C., 11 g of benzyl bromide was added thereto, and

SYNTHESIS EXAMPLE A-1

Synthesis of Resin (A-1)

A mixed solution of 80 g of ethyl methacrylate, 20 g of Macromonomer (M-1) and 150 g of toluene was heated at 95° C. under nitrogen gas stream, and 6 g of 2,2'-azobis(isobutyronitrile) (hereinafter simply referred to as AIBN) was added thereto to effect reaction for 3 hours. Then, 2 g of AIBN was further added thereto, followed by reacting for 2 hours, and thereafter 2 g of AIBN was added thereto, followed by reacting for 2 hours. The resulting copolymer shown below had an Mw of $9\times10^3$.

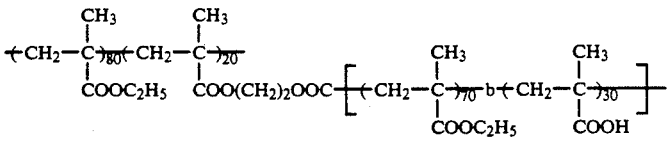

(A-1)

SYNTHESIS EXAMPLE A-2

Synthesis of Resin (A-2)

A mixed solution of 70 g of 2-chlorophenyl methacrylate, 30 g of Macromonomer (M-2), 2 g of n-dodecylmercaptan and 100 g of toluene was heated at 80° C. under nitrogen gas stream, and 3 g of 2,2'-azobis-(isovaleronitrile) (hereinafter simply referred to as was added thereto to effect reaction for 3 hours. Then, 1 g of AIVN was further added, followed by reacting for 2 hours, and thereafter 1 g of AIBN was added thereto, followed by heating to 90° C. and reacting for 3 hours. The resulting copolymer shown below had an Mw of $7.6\times10^3$.

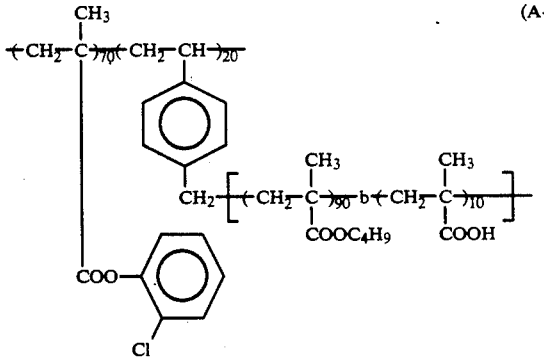

(A-2)

SYNTHESIS EXAMPLES A-3 TO A-18

Synthesis of Resins (A-3) to (A-18)

Resins (A) shown in Table 1 below were synthesized under the same polymerization conditions as described in Synthesis Example A-1 except for using the monomers shown in Table 1 in place of the ethyl methacrylate, respectively. Each of these resins had an Mw of from $5\times10^3$ to $9\times10^3$.

TABLE 1

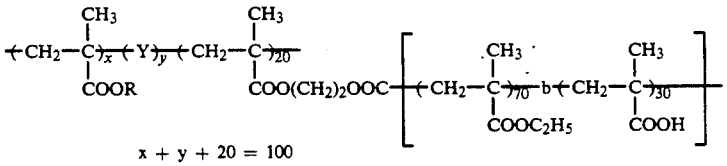

x + y + 20 = 100

| Synthesis Example | Resin (A) | —R | —Y— | x/y (weight ratio) |
|---|---|---|---|---|
| A-3 | (A-3) | $-C_4H_9$ | — | 80/0 |
| A-4 | (A-4) | $-CH_2C_6H_5$ | — | 80/0 |
| A-5 | (A-5) | $-C_6H_5$ | — | 80/0 |
| A-6 | (A-6) | $-C_4H_9$ | $-CH_2-CH-$ 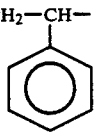 | 65/15 |
| A-7 | (A-7) | $-CH_2C_6H_5$ | $-CH_2-CH-$ (COOCH₃) | 70/10 |
| A-8 | (A-8) | 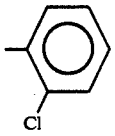 | — | 80/0 |

TABLE 1-continued
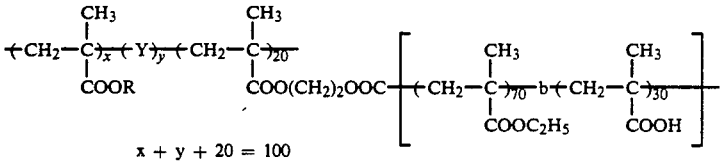
$x + y + 20 = 100$
| Synthesis Example | Resin (A) | —R | —Y— | x/y (weight ratio) |
|---|---|---|---|---|
| A-9 | (A-9) | 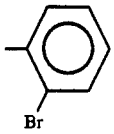 | — | 80/0 |
| A-10 | (A-10) | 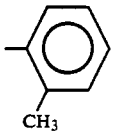 | — | 80/0 |
| A-11 | (A-11) | 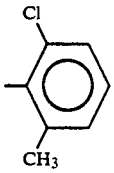 | — | 80/0 |
| A-12 | (A-12) | 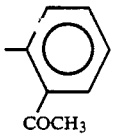 | — | 80/0 |
| A-13 | (A-13) | 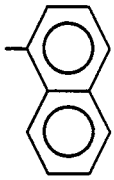 | $-CH_2-CH-$ (COOC$_2$H$_5$) | 70/10 |
| A-14 | (A-14) | 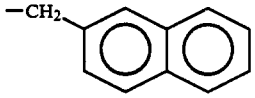 | — | 80/0 |
| A-15 | (A-15) | $-CH_3$ | $-CH_2-C-$ (CH$_3$, COOC$_4$H$_9$) | 40/40 |
| A-16 | (A-16) | $-CH_2C_6H_5$ | $-CH_2-C-$ (CH$_3$, COO(CH$_2$)$_2$CN) | 65/15 |
| A-17 | (A-17) | $-C_6H_5$ | $-CH_2-CH-$ (CONH$_2$) | 72/8 |

TABLE 1-continued

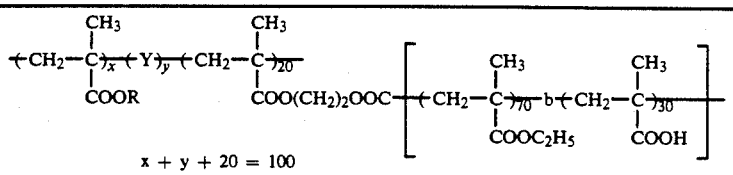

x + y + 20 = 100

| Synthesis Example | Resin (A) | —R | —Y— | x/y (weight ratio) |
|---|---|---|---|---|
| A-18 | (A-18) | 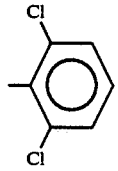 | — | 80/0 |

SYNTHESIS EXAMPLES A-19 TO A-35

Synthesis of Resins (A-19) to (A-35)

Resins (A) shown in Table 2 below were synthesized under the same polymerization conditions as described in Synthesis Example A-2 except for using the macromonomers (M) shown in Table 2 in place of Macromonomer (M-2), respectively. Each of these resins had an Mw of from $2\times10^3$ to $1\times10^4$.

TABLE 2
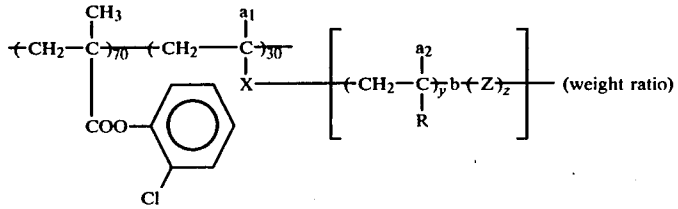
| Synthesis Example No. | Resin (A) | —X— | $a_1/a_2$ | —R | —Z— | x/y (weight ratio) |
|---|---|---|---|---|---|---|
| A-19 | (A-19) | $-COO(CH_2)_2OOC-$ | $H/-CH_3$ | $-COOCH_3$ | $-CH_2-CH(COOH)-$ | 70/30 |
| A-20 | (A-20) | $-COOCH_2CH(OH)CH_2OOC-$ | $-CH_3/-CH_3$ | $-COOCH_2C_6H_5$ | $-CH_2-CH-$ 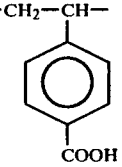 | 60/40 |
| A-21 | (A-21) | 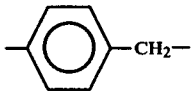 | $-H/-CH_3$ | $-COOC_6H_5$ | $-CH_2-C(CH_3)(COO(CH_2)_2COOH)-$ | 65/35 |
| A-22 | (A-22) | $-COO(CH_2)_2OCO(CH_2)_2-$ $-COO(CH_2)_2-$ | $-CH_3/-CH_3$ | $-COOC_2H_5$ | $-CH_2-C(CH_3)(COOH)-$ | 80/20 |
| A-23 | (A-23) | $-COOCH_2CH_2-$ | $-CH_3/-H$ | $-C_6H_5$ | $-CH_2-CH-$ 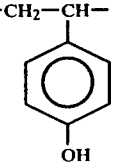 | 50/50 |
| A-24 | (A-24) | $-COOCH_2CH(OH)CH_2OOC-$ | $-CH_3/-CH_3$ | $-COOC_2H_5$ | $-CH_2-C(CH_3)(COO(CH_2)_3SO_3H)-$ | 90/10 |

TABLE 2-continued
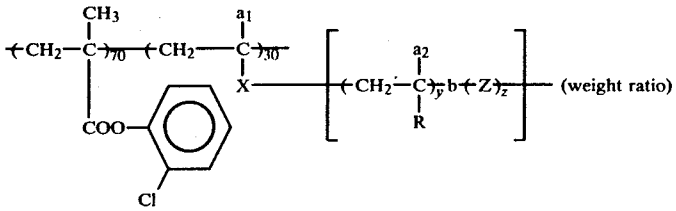
| Synthesis Example No. | Resin (A) | —X— | $a_1/a_2$ | —R | —Z— | x/y (weight ratio) |
|---|---|---|---|---|---|---|
| A-25 | (A-25) | 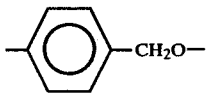 | —H/—$CH_3$ | —$COOC_3H_7$ | 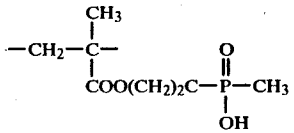 | 80/20 |
| A-26 | (A-26) | 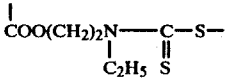 | —$CH_3$/—$CH_3$ | —$COOC_2H_5$ | 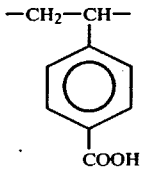 | 65/35 |
| A-27 | (A-27) | " | —$CH_3$/—H | —$COOC_6H_5$ | 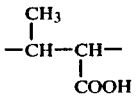 | 70/30 |
| A-28 | (A-28) |  | —$CH_3$/—$CH_3$ | " | 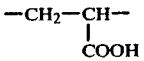 | 75/25 |
| A-29 | (A-29) | —$COOCH_2CH_2$— | —$CH_3$/—H | —$C_6H_5$ | 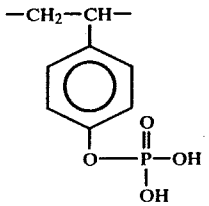 | 90/10 |

TABLE 2-continued

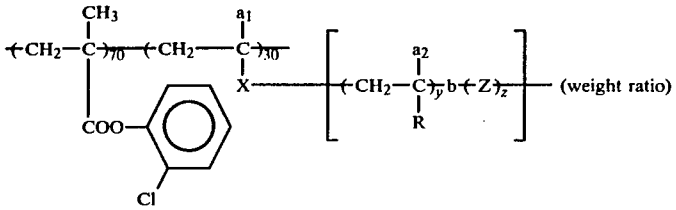

| Synthesis Example No. | Resin (A) | —X— | $a_1/a_2$ | —R | —Z— | x/y (weight ratio) |
|---|---|---|---|---|---|---|
| A-30 | (A-30) | $\vert$ CONHCOOCH$_2$CH$_2$— | —CH$_3$/—CH$_3$ | —COOCH$_2$C$_6$H$_5$ | —CH$_2$—C(CH$_3$)(COO(CH$_2$)$_2$OCO—C$_6$H$_3$(COOH)—COOH)— | 70/30 |
| A-31 | (A-31) | —C$_6$H$_4$—Si(CH$_3$)$_2$— | —H/—CH$_3$ | —COOC$_4$H$_9$ | —CH$_2$—C(COOH)(CH$_2$COOH)— | 80/20 |
| A-32 | (A-32) | —COO— | —CH$_3$/—CH$_3$ | —COOCH$_3$ | —CH$_2$—CH(COOH)— | 70/30 |
| A-33 | (A-33) | —COO(CH$_2$)$_4$OOC— | —CH$_3$/—CH$_3$ | —COO—C$_6$H$_3$(CH$_3$)— | —CH$_2$—CH—C$_6$H$_4$—O—P(=O)(OH)—OH | 75/25 |
| A-34 | (A-34) | —C$_6$H$_4$—O— | —H/—H | —C$_6$H$_5$ | —CH$_2$—CH—C$_6$H$_4$—COOH | 70/30 |

TABLE 2-continued
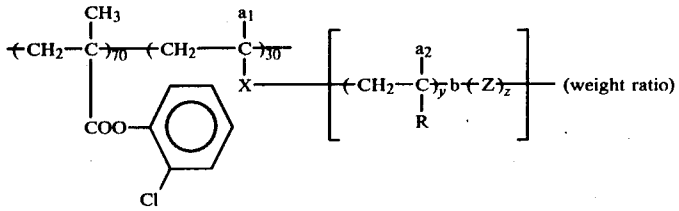
| Synthesis Example No. | Resin (A) | —X— | $a_1/a_2$ | —R | —Z— | x/y (weight ratio) |
|---|---|---|---|---|---|---|
| A-35 | (A-35) | $-\underset{\underset{S}{\parallel}}{\overset{\vert}{C}}ONHC-S-$ | —H/—$CH_3$ | —$COOCH_2C_6H_5$ | $-CH_2-\overset{CH_3}{\overset{\vert}{\underset{\underset{COO(CH_2)_2O-\overset{O}{\overset{\parallel}{\underset{OH}{\overset{\vert}{P}}}}-OH}{\vert}}{C}}}-$ | 85/15 |

SYNTHESIS EXAMPLE B-1

Synthesis of Resin (B-1)

A mixed solution of 100 g of ethyl methacrylate, 1.0 g of ethylene glycol dimethacrylate, and 200 g of toluene was heated to 75° C. under nitrogen gas stream, and 1.0 g of AIBN was added thereto to conduct a reaction for 10 hours. The resulting copolymer, i.e., Resin (B-1) had a weight average molecular weight of $4.2 \times 10^5$.

SYNTHESIS EXAMPLES B-2 TO B-19

Synthesis of Resins (B-2) TO (B-19)

Resins (B) shown in Table 3 below were prepared under the same polymerization conditions as in Synthesis Example B-1, except for using each of the monomers and crosslinking monomers shown in Table 3 below, respectively.

TABLE 3

| Synthesis Example No. | Resin (B) | Monomer | Crosslinking Monomer | Mw of Resin (B) |
|---|---|---|---|---|
| 2 | B-2 | ethyl methacrylate (100 g) | propylene glycol dimethacrylate (1.0 g) | $2.4 \times 10^5$ |
| 3 | B-3 | butyl methacrylate (100 g) | diethylene glycol dimethacrylate (0.8 g) | $3.4 \times 10^5$ |
| 4 | B-3 | propyl methacrylate (100 g) | vinyl methacrylate (3 g) | $9.5 \times 10^5$ |
| 5 | B-5 | methyl methacrylate (80 g) ethyl acrylate (20 g) | divinylbenzene (0.8 g) | $8.8 \times 10^5$ |
| 6 | B-6 | ethyl methacrylate (75 g) methyl acrylate (25 g) | diethylene glycol diacrylate (0.8 g) | $2.0 \times 10^5$ |
| 7 | B-7 | styrene (20 g) butyl methacrylate (80 g) | triethylene glycol trimethycrylate (0.5 g) | $3.3 \times 10^5$ |
| 8 | B-8 | methyl methacrylate (40 g) propyl methacrylate (60 g) | IPS-22GA (produced by Okamura Seiyu K.K.) (0.9 g) | $3.6 \times 10^5$ |
| 9 | B-9 | benzyl methacrylate (100 g) | ethylene glycol dimethacrylate (0.8 g) | $2.4 \times 10^5$ |
| 10 | B-10 | butyl methacrylate (95 g) 2-hydroxyethyl methacrylate (5 g) | ethylene glycol dimethacrylate (0.8 g) | $2.0 \times 10^5$ |
| 11 | B-11 | ethyl methacrylate (90 g) acrylonitrile (10 g) | divinylbenzene (0.7 g) | $1.0 \times 10^5$ |
| 12 | B-12 | ethyl methacrylate (99.5 g) methacrylic acid (0.5 g) | triethylene glycol dimethacrylate (0.8 g) | $1.5 \times 10^5$ |
| 13 | B-13 | butyl methacrylate (70 g) phenyl methacrylate (30 g) | diethylene glycol dimethacrylate (1.0 g) | $2.0 \times 10^5$ |
| 14 | B-14 | ethyl methacrylate (95 g) acrylamide (5 g) | triethylene glycol dimethacrylate (1.0 g) | $2.4 \times 10^5$ |
| 15 | B-15 | propyl methacrylate (92 g) N,N-dimethylaminoethyl methacrylate (8 g) | divinylbenzene (1.0 g) | $1.8 \times 10^5$ |
| 16 | B-16 | ethyl methacrylate (70 g) methyl crotonate (30 g) | divinylbenzene (0.8 g) | $1.4 \times 10^5$ |
| 17 | B-17 | propyl methacrylate (95 g) diacetonacrylamide (5 g) | propylene glycol dimethacrylate (0.8 g) | $1.8 \times 10^5$ |
| 18 | B-18 | ethyl methacrylate (93 g) 6-hydroxyhexamethylene methacrylate (7 g) | ethylene glycol dimethacrylate (0.8 g) | $2.0 \times 10^5$ |
| 19 | B-19 | ethyl methacrylate (90 g) 2-cyanoethyl methacrylate (10 g) | ethylene glycol dimethacrylate (0.8 g) | $1.8 \times 10^5$ |

SYNTHESIS EXAMPLE B-20

Synthesis of Resin (B-20)

A mixed solution of 99 g of ethyl methacrylate, 1 g of ethylene glycol dimethacrylate, 150 g of toluene, and 50 g of methanol was heated to 70° C. under nitrogen gas stream, and 1.0 g of 4,4'-azobis(4-cyanopentanoic acid) was added thereto to conduct a reaction for 8 hours. The resulting copolymer; i.e., Resin (B-20) had a weight average molecular weight of $1.0 \times 10^5$.

SYNTHESIS EXAMPLES B-21 TO B-24

Synthesis of Resins (B-21) TO (B-24)

Resins (B) shown in Table 4 below were prepared under the same conditions as in Synthesis Example B-20, except for replacing 4,4'-azobis(4-cyanopentanoic acid) used as the polymerization initiator with each of the compounds shown in Table 4 below, respectively. The weight average molecular weight of each resin obtained was in a range of from $1.0 \times 10^5$ to $3 \times 10^5$.

TABLE 4

| Synthesis Example No. | Resin (B) | Polymerization Initiator R—N=N—R | R— |
|---|---|---|---|
| 21 | B-21 | 2,2'-azobis(2-cyanopropanol) | $HO-CH_2-C(CH_3)(CN)-$ |

TABLE 4-continued

| Synthesis Example No. | Resin (B) | Polymerization Initiator | R—N=N—R<br>R— |
|---|---|---|---|
| 22 | B-22 | 2,2'-azobis(2-cyanopentanol) | $HOCH_2CH_2CH_2-C(CH_3)(CN)-$ |
| 23 | B-23 | 2,2'-azobis[2-methyl-N-(2-hydroxyethyl)propionamide] | $HOCH_2CH_2NH-C(=O)-C(CH_3)-$ |
| 24 | B-24 | 2,2'-azobis{2-methyl-N-[1,1-bishydroxymethyl)-2-hydroxyethyl]-propionamide} | $(HOCH_2)_2HOH_2C-C-NH-C(=O)-C(CH_3)-$ |

SYNTHESIS EXAMPLE B-25

Synthesis of Resin (B-25)

A mixed solution of 99 g of ethyl methacrylate, 1.0 g of thioglycolic acid, 2.0 g of divinylbenzene, and 200 g of toluene was heated to 80° C. under nitrogen gas stream. To the mixture was added 0.8 g of 2,2'-azobis (cyclohexane-1-carbonitrile) (hereinafter simply referred to as ACHN) to conduct a reaction for 4 hours. Then, 0.4 g of ACHN was added thereto, followed by reacting for 2 hours, and 0.2 g of ACHN was further added thereto, followed by reacting for 2 hours. The resulting copolymer, i.e., Resin (B-25) had a weight average molecular weight of $1.2\times10^5$.

SYNTHESIS EXAMPLES B-26 TO B-38

Synthesis of Resins (B-26) TO (B-38)

Resins (B) shown in Table 5 below were prepared under the same manner as in Synthesis Example B-25, except for replacing 2.0 g of divinylbenzene used as the crosslinking polyfunctional monomer with each of the polyfunctional monomers and oligomers shown in Table 5 below, respectively.

TABLE 5

| Synthesis Example No. | Resin (B) | Crosslinking Monomer or Oligomer | Mw |
|---|---|---|---|
| 26 | B-26 | ethylene glycol dimethacrylate (2.5 g) | $2.2\times10^5$ |
| 27 | B-27 | diethylene glycol dimethacrylate (3 g) | $2.0\times10^5$ |
| 28 | B-28 | vinyl methacrylate (6 g) | $1.8\times10^5$ |
| 39 | B-29 | isopropenyl methacrylate (6 g) | $2.0\times10^5$ |
| 30 | B-30 | divinyl adipate (10 g) | $1.0\times10^5$ |
| 31 | B-31 | diallyl glutaconate (10 g) | $9.5\times10^5$ |
| 32 | B-32 | IPS-22GA (produced by Okamura Seiyu K.K.) (5 g) | $1.5\times10^5$ |
| 33 | B-33 | triethylene glycol diacrylate (2 g) | $2.8\times10^5$ |
| 34 | B-34 | trivinylbenzene (0.8 g) | $3.0\times10^5$ |
| 35 | B-35 | polyethylene glycol #400 diacrylate (3 g) | $2.5\times10^5$ |
| 36 | B-36 | polyethylene glycol dimethacrylate (3 g) | $2.5\times10^5$ |
| 37 | B-37 | trimethylolpropane triacrylate (0.5 g) | $1.8\times10^5$ |
| 38 | B-38 | polyethylene glycol #600 diacrylate (3 g) | $2.8\times10^5$ |

SYNTHESIS EXAMPLES B-39 TO B-49

Synthesis of Resins (B-39) TO (B-49)

A mixed solution of 39 g of methyl methacrylate, 60 g of ethyl methacrylate, 1.0 g of each of the mercapto compounds shown in Table 6 below, 2 g of ethylene glycol dimethacrylate, 150 g of toluene, and 50 g of methanol was heated to 70° C. under nitrogen gas stream. To the mixture was added 0.8 g of AIBN to conduct a reaction for 4 hours. Then, 0.4 g of AIBN was further added thereto to conduct a reaction for 4 hours. The weight average molecular weight of each copolymer obtained was in a range of $9.5\times10^4$ to $2\times10^5$.

TABLE 6

| Synthesis Example No. | Resin (B) | Mercapto Compound |
|---|---|---|
| 39 | B-39 | $HSCHCOOH(CH_2COOH)$ |
| 40 | B-40 | 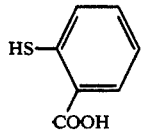 |
| 41 | B-41 | $HSCH_2CH_2NH_2$ |
| 42 | B-42 | $HSCH_2CH_2O-P(=O)(OH)-OH$ |

TABLE 6-continued

| Synthesis Example No. | Resin (B) | Mercapto Compound |
|---|---|---|
| 43 | B-43 | $HSCH_2CH_2O-\overset{\overset{O}{\|}}{P}(OC_2H_5)-OH$ |
| 44 | B-44 | 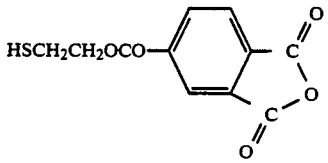 |
| 45 | B-45 | $HSCH_2CH_2COOH$ |
| 46 | B-46 | 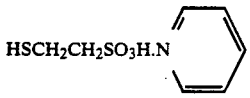 |
| 47 | B-47 | $HSCH_2CH_2NHCO(CH_2)_3COOH$ |
| 48 | B-48 | $HSCH_2CH_2N(CH_3)_2$ |
| 49 | B-49 | $HSCH_2CH_2OH$ |

EXAMPLE 1

A mixture of 6 g (solid basis, hereinafter the same) of Resin (A-2), 34 g (solid basis, hereinafter the same) of Resin (B-20), 200 g of zinc oxide, 0.018 g of Cyanine Dye (I) shown below, and 300 g of toluene was dispersed in a ball mill for 3 hours to prepare a coating composition for a light-sensitive layer. The coating composition was coated on paper, which has been subjected to electrically conductive treatment, by a wire bar at a dry coverage of 25 g/m$^2$, followed by drying at 110° C. for 30 seconds. The coated material was then allowed to stand in a dark place at 20° C. and 65% RH (relative humidity) for 24 hours to prepare an electrophotographic light-sensitive material.

Cyanine Dye (I):

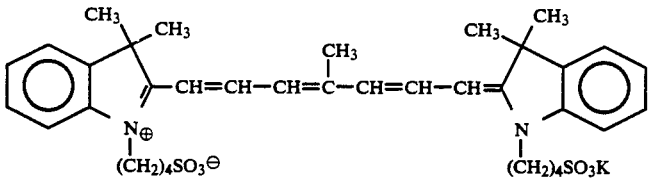

COMPARATIVE EXAMPLE A

An electrophotographic light-sensitive material was prepared in the same manner as in Example 1, except for using 6 g of Resin (R-1) shown below in place of 6 g of Resin (A-2) used in Example 1.

Resin (R-1):

-continued

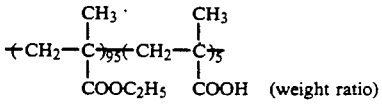

Mw: 6.5 × 10$^3$

COMPARATIVE EXAMPLE B

An electrophotographic light-sensitive material was prepared in the same manner as in Example 1, except for using 6 g of Resin (R-2) shown below in place of 6 g of Resin (A-2) used in Example 1.

Resin (R-2):

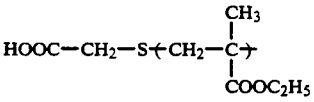

Mw: 6.0 × 10$^3$

Each of the light-sensitive materials obtained in Example 1 and Comparative Examples A and B was evaluated for film properties in terms of surface smoothness and mechanical strength; electrostatic characteristics; image forming performance; oil-desensitivity when used as an offset master plate precursor (expressed in terms of contact angle of the layer with water after oil-desensitization treatment); and printing suitability (expressed in terms of background stains and printing durability) according to the following test methods. The results obtained are shown in Table 7 below.

1) Smoothness of Photoconductive Layer

The smoothness (sec/cc) was measured using a Beck's smoothness tester (manufactured by Kumagaya Riko K.K.) under an air volume condition of 1 cc.

2) Mechanical Strength of Photoconductive Layer

The surface of the light-sensitive material was repeatedly (1000 times) rubbed with emery paper (#1000) under a load of 60 g/cm$^2$ using a Heidon 14 Model surface testing machine (manufactured by Shinto Kagaku K.K.). After dusting, the abrasion loss of the photoconductive layer was measured to obtain film retention (%), which was referred to as the mechanical strength.

3) Electrostatic Characteristics

The sample was charged with a corona discharge to a voltage of −6 kV for 20 seconds in a dark room at 20° C. and 65% RH using a paper analyzer ("Paper Analyzer SP-428" manufactured by Kawaguchi Denki K.K.) Ten seconds after the corona discharge, the surface potential $V_{10}$ was measured. The sample was allowed to stand in the dark for an additional 120 seconds, and the potential $V_{130}$ was measured. The dark decay retention rate (DRR; %), i.e., percent retention of potential after dark decay for 120 seconds, was calculated from the following equation:

$$DRR\ (\%) = (V_{130}/V_{10}) \times 100$$

Separately, the sample was charged to −500 V with a corona discharge and then exposed to monochromatic light having a wavelength of 785 nm, and the time required for decay of the surface potential $V_{10}$ to one-tenth was measured to obtain an exposure amount $E_{1/10}$ (erg/cm$^2$).

Further, the sample was charged to −500 V with a corona discharge in the same manner as described for the measurement of $E_{1/10}$, then exposed to monochromatic light having a wavelength of 785 nm, and the time required for decay of the surface potential $V_{10}$ to one-hundredth was measured to obtain an exposure amount $E_{1/100}$ (erg/cm$^2$).

The measurements were conducted under conditions of 20° C. and 65% RH (hereinafter referred to as Condition I) or 30° C. and 80% RH (hereinafter referred to as Condition II).

4) Image Forming Performance

After the samples were allowed to stand for one day under Condition I or II, each sample was charged to −5 kV and exposed to light emitted from a gallium-aluminum-arsenic semi-conductor laser (oscillation wavelength: 785 nm; output: 2.8 mW) at an exposure amount of 50 erg/cm$^2$ (on the surface of the photoconductive layer) at a pitch of 25 μm and a scanning speed of 300 m/sec. The thus formed electrostatic latent image was developed with a liquid developer ("ELP-T" produced by Fuji Photo Film Co., Ltd.), followed by fixing. The duplicated image obtained was visually evaluated for fog and image quality.

5) Contact Angle With Water

The sample was passed once through an etching processor using an oil-desensitizing solution ("ELP-EX" produced by Fuji Photo Film Co., Ltd.) diluted to a two-fold volume with distilled water to render the surface of the photoconductive layer oil-desensitive. On the thus oil-desensitized surface was placed a drop of 2 μl of distilled water, and the contact angle formed between the surface and water was measured using a goniometer.

6) Printing Durability

The sample was processed in the same manner as described in 4) above to form toner images, and the surface of the photoconductive layer was subjected to oil-desensitization treatment under the same conditions as in 5) above. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

TABLE 7

| | Example 1 | Comparative Example A | Comparative Example B |
|---|---|---|---|
| Surface Smoothness[1] (sec/cc) | 380 | 350 | 360 |
| Film Strength[2] (%) | 97 | 98 | 97 |
| Electrostatic[3] Characteristics: | | | |
| $V_{10}$ (−V): | | | |
| Condition I | 650 | 430 | 480 |
| Condition II | 630 | 385 | 430 |
| DRR (%): | | | |
| Condition I | 88 | 63 | 70 |
| Condition II | 83 | 50 | 63 |
| $E_{1/10}$ (erg/cm$^2$): | | | |
| Condition I | 15 | 66 | 46 |
| Condition II | 18 | 57 | 40 |
| $E_{1/100}$ (erg/cm$^2$): | | | |
| Condition I | 23 | 120 | 91 |
| Condition II | 28 | 135 | 100 |
| Image-Forming Performance[4]: | | | |
| Condition I | Very Good | Poor (reduced Dmax, background fog) | No Good (scratches of fine lines, slight background fog) |
| Condition II | Very Good | Poor (reduced Dmax, background fog) | Poor (reduced Dmax, background fog) |
| Contact Angle[5] With Water (°) | 10 or less | 10 or less | 10 or less |
| Printing Durability[6]: | 10,000 or more | Background stains from the start of printing | Background stains from the start of printing |

As can be seen from the results shown in Table 7, the light-sensitive material according to the present invention had good surface smoothness, film strength and electrostatic characteristics. The duplicated image obtained was clear and free from background fog in the non-image area. These results appear to be due to the sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic, as shown by a small contact angle of 10° C. or less with water. On practical printing using the resulting master plate, no background stains were observed in the prints.

The samples of Comparative Examples A and B exhibited poor electrostatic characteristics as compared with the light-sensitive material according to the present invention. Particularly, the DRR value was further decreased under the high temperature and high humidity condition. Since the DRR value was small, the E values become apparently low. On such a level of the electrostatic characteristics, the duplicated images obtained are degraded and can not be practically employed when the environmental conditions of image formation are varied or coarse originals (for example, these of faint letters or tinted background) are used, although duplicated images obtained under proper image-forming conditions are practically utilized.

Further, the value of $E_{1/100}$ is largely different between the eight-sensitive material of the present invention and those for comparison.

The value of $E_{1/100}$ indicates an electrical potential remaining in the non-image areas after exposure at the practice of image formation. The smaller this value, the less the background fog in the non-image areas. More specifically, it is requested that the remaining potential is decreased to −10 V or less. Therefore, an amount of exposure necessary to make the remaining potential below −10 V is an important factor. In the scanning exposure system using a semiconductor laser beam, it is quite importan' to make the remaining potential below −10 V by a small exposure amount in view of a design for an optical system of a duplicator (such as cost of the device, and accuracy of the optical system).

When the sample of Comparative Example A or B was actually imagewise exposed by a device of a small amount of exposure, the noticeable degradation of duplicated image, that is, occurrence of scratches of fine lines in the image areas and background fog in the non-image areas were observed.

Furthermore, when these samples were employed as offset master plate precursors, the samples of Comparative Examples A and B exhibited the background stains in the non-image area from the start of printing under the printing conditions under which the sample according to the present invention provided more than 10,000 prints of good quality.

From all these considerations, it is thus clear that an electrophotographic light-sensitive material satisfying both requirements of electrostatic characteristics and printing suitability can be obtained only using the binder resin according to the present invention.

EXAMPLES 2 TO 17

Each electrophotographic light-sensitive material was prepared in the same manner as described in Example 1, except for replacing Resin (A-2) and Resin (B-20) with each of the resins (A) and (B) shown in Table 8 below, respectively.

The electrostatic characteristics of the resulting light-sensitive materials were evaluated in the same manner as described in Example 1. The results obtained are shown in Table 8 below. The electrostatic characteristics in Table 8 are those determined under Condition II (30° C. and 80% RH).

TABLE 8

| Example No. | Resin (A) | Resin (B) | $V_{10}$ (−V) | DRR (%) | $E_{1/10}$ (erg/cm$^2$) | $E_{1/100}$ (erg/cm$^2$) |
|---|---|---|---|---|---|---|
| 2 | A-4 | B-20 | 560 | 78 | 38 | 56 |
| 3 | A-5 | B-24 | 545 | 75 | 35 | 58 |
| 4 | A-8 | B-25 | 625 | 86 | 20 | 30 |
| 5 | A-9 | B-25 | 600 | 82 | 23 | 33 |
| 6 | A-10 | B-26 | 550 | 80 | 25 | 35 |
| 7 | A-11 | B-27 | 640 | 85 | 18 | 27 |
| 8 | A-12 | B-33 | 555 | 83 | 19 | 28 |
| 9 | A-18 | B-34 | 605 | 85 | 18 | 26 |
| 10 | A-21 | B-36 | 630 | 85 | 17 | 25 |
| 11 | A-23 | B-35 | 580 | 81 | 22 | 30 |
| 12 | A-24 | B-39 | 600 | 83 | 20 | 32 |
| 13 | A-25 | B-40 | 605 | 83 | 20 | 30 |
| 14 | A-26 | B-42 | 630 | 85 | 19 | 29 |
| 15 | A-29 | B-43 | 590 | 82 | 21 | 33 |
| 16 | A-32 | B-44 | 585 | 83 | 22 | 35 |
| 17 | A-35 | B-46 | 620 | 85 | 20 | 31 |

Further, when these electrophotographic light-sensitive materials were employed as offset master plate precursors under the same printing condition as described in Example 1, more than 10,000 good prints were obtained respectively.

It can be seen from the results described above that each of the light-sensitive materials according to the present invention was satisfactory in all aspects of the surface smoothness and film strength of the photoconductive layer, electrostatic characteristics, and printing suitability.

Further, it can be seen that the electrostatic characteristics are further improved by the use of the resin (A').

EXAMPLES 18 TO 27

Each electrophotographic light-sensitive material was prepared in the same manner as described in Example 1, except for replacing 6 g of Resin (A-2) with 6 g each of the resins (A) shown in Table 9 below, replacing 34 g of Resin (B-20) with 34 g each of the resins (B) shown in Table 9 below, and replacing 0.018 g of Cyanine Dye (I) with 0.019 g of Dye (II) shown below.

TABLE 9

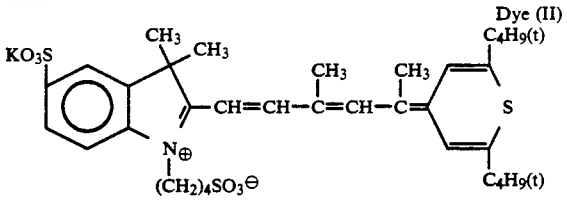

| Example No. | Resin (A) | Resin (B) |
|---|---|---|
| 18 | A-1 | B-21 |
| 19 | A-2 | B-22 |
| 20 | A-4 | B-23 |
| 21 | A-7 | B-24 |
| 22 | A-11 | B-25 |
| 23 | A-13 | B-28 |
| 24 | A-14 | B-30 |
| 25 | A-17 | B-38 |
| 26 | A-18 | B-41 |
| 27 | A-24 | B-47 |

As the results of the evaluation as described in Example 1, it can be seen that each of the light-sensitive materials according to the present invention is excellent in charging properties, dark charge retention rate, and photosensitivity, and provides a clear duplicated image free from background fog even when processed under severe conditions of high temperature and high humidity (30° C. and 80% RH). Further, when these materials were employed as offset master plate precursors, more than 10,000 prints of a clear image free from background stains were obtained respectively.

EXAMPLES 28 AND 29

A mixture of 6.5 g of Resin (A-1) (Example 28) or Resin (A-2) (Example 29), 33.5 g of Resin (B-21), 200 g of zinc oxide, 0.02 g of uranine, 0.03 g of Methine Dye (D) shown below, 0.03 G of Methine Dye (E) shown below, 0.18 g of p-hydroxybenzoic acid, and 300 g of toluene was dispersed by a homogenizer (manufactured by Nippon Seki K.K.) at $1\times10^4$ r.p.m. for 15 minutes to prepare a coating composition for a light-sensitive layer. The coating composition was coated on paper, which had been subjected to electrically conductive treatment, by a wire bar at a dry coverage of 25 g/m$^2$, and dried for 1 minute at 110° C. Then, the coated material was allowed to stand in a dark place for 24 hours under the conditions of 20° C. and 65% RH to prepare each electrophotographic light-sensitive material.

Methine Dye (D):

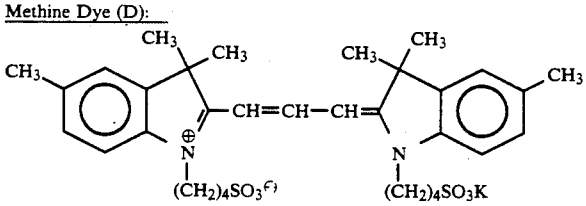

Methine Dye (E):

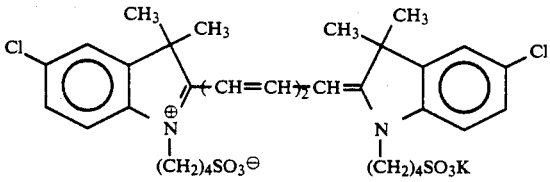

COMPARATIVE EXAMPLE C

An electrophotographic light-sensitive material was prepared in the same manner as in Example 28, except for replacing 6.5 g of Resin (A-1) with 6.5 g of Resin (R-2) described above.

Each of the light-sensitive materials obtained in Examples 28 and 29 and Comparative Example C was evaluated in the same manner as in Example 1, except that the electrostatic characteristics and image forming performance were evaluated according to the following test methods.

7) Electrostatic Characteristics: $E_{1/10}$ and $E_{1/100}$

The surface of the photoconductive layer was charged to −400 V with corona discharge, then irradiated by visible light of the illuminance of 2.0 lux, the time required for decay of the surface potential ($V_{10}$) to 1/10 or 1/100 thereof, and the exposure amount $E_{1/10}$ or $E_{1/100}$ (lux·sec) was calculated therefrom.

8) Image Forming Performance

The electrophotographic light-sensitive material was allowed to stand for one day under the environmental conditions of 20° C. and 65% RH (Condition I) or 30° C. and 80% RH (Condition II), the light-sensitive material was subjected to plate making by a full-automatic plate making machine (ELP-404V made by Fuji Photo Film Co., Ltd.) using ELP-T as a toner. The duplicated image thus obtained was visually evaluated for fog and image quality. The original used for the duplication was composed of cuttings of other originals pasted up thereon.

The results obtained are shown in Table 10 below.

TABLE 10

| | Example 28 | Example 29 | Comparative Example C |
|---|---|---|---|
| Binder Resin | (A-1)/(B-21) | (A-2)/(B-21) | (R-2)/(B-21) |
| Surface Smoothness (sec/cc) | 800 | 830 | 810 |
| Film Strength (%) | 98 | 97 | 92 |
| Electrostatic[7] Characteristics: | | | |
| $V_{10}$ (−V): | | | |
| Condition I | 585 | 640 | 510 |
| Condition II | 570 | 630 | 470 |
| DRR (%): | | | |
| Condition I | 92 | 97 | 87 |
| Condition II | 90 | 96 | 82 |
| $E_{1/10}$ (lux · sec): | | | |
| Condition I | 10.8 | 8.2 | 14.5 |
| Condition II | 11.5 | 8.6 | 15.8 |
| $E_{1/100}$ (lux · sec): | | | |
| Condition I | 25 | 18 | 48 |
| Condition II | 30 | 20 | 53 |

TABLE 10-continued

| | Example 28 | Example 29 | Comparative Example C |
|---|---|---|---|
| Image-Forming Performance[8]: | | | |
| Condition I | Good | Very Good | Poor (edge mark of cutting) |
| Condition II | Good | Very Good | Poor (sever edge mark of cutting) |
| Contact Angle With Water (°) | 10 or less | 10 or less | 10 or less |
| Printing Durability: | 10,000 | 10,000 | Background stains due to edge mark of cutting from the start of printing |

From the results shown in Table 10 above, it can be seen that each light-sensitive material exhibits almost same properties with respect to the surface smoothness and mechanical strength of the photoconductive layer. However, on the electrostatic characteristics, the sample of Comparative Example C has the particularly large value of $E_{1/100}$ which becomes larger under the high temperature and high humidity conditions. On the contrary, the electrostatic characteristics of the light-sensitive material according to the present invention are good. Further, those of Example 29 using the resin (A') having the specific substituent are very good. The value of $E_{1/100}$ is particularly small.

With respect to image-forming performance, the edge mark of cuttings pasted up was observed as background fog in the non-image areas in the sample of Comparative Example C. On the contrary, the samples according to the present invention provided clear duplicated images free from background fog.

Further, each of these samples was subjected to the oil-desensitizing treatment to prepare an offset printing plate and printing was conducted. The samples according to the present invention provided 10,000 prints of clear image without background stains. However, with the sample of Comparative Example C, the above described edge mark of cuttings pasted up was not removed with the oil-desensitizing treatment and the background stains occurred from the start of printing.

As can be seen from the above results, only the light-sensitive material according to the present invention can provide the excellent performance.

EXAMPLES 30 TO 41

Each electrophotographic light-sensitive material was prepared in the same manner as described in Example 28, except for replacing 6.5 g Resin (A-1) with 6.5 g of each of the resins (A) shown in Table 11 below, and replacing 33.5 g of Resin (B-21) with 33.5 g of each of the resins (B) shown in Table 11 below, respectively.

TABLE 11

| Example No. | Resin (A) | Resin (B) |
|---|---|---|
| 30 | A-3 | B-1 |
| 31 | A-4 | B-5 |
| 32 | A-5 | B-6 |
| 33 | A-6 | B-12 |
| 34 | A-7 | B-17 |
| 35 | A-15 | B-22 |
| 36 | A-16 | B-25 |
| 37 | A-17 | B-28 |
| 38 | A-22 | B-44 |
| 39 | A-30 | B-42 |
| 40 | A-31 | B-43 |
| 41 | A-35 | B-46 |

As the results of the evaluation as described Example 28, it can be seen that each of the light-sensitive materials according to the present invention is excellent in charging properties, dark charge retention rate, and photosensitivity, and provides a clear duplicated image free from background fog and scratches of fine lines even when processed under severe conditions of high temperature and high humidity (30° C. and 80% RH). Further, when these materials were employed as offset master plate precursors, more than 7,000 prints of a clear image free from background stains were obtained respectively.

EXAMPLE 44

A mixture of 7 g of Resin (A-36) shown below and 31 g of Resin (B-18), 200 g of zinc oxide, 0.02 g of uranine, 0.04 g of Rose Bengal, 0.03 g of bromophenol blue, 0.20 g of phthalic anhydride and 300 g of toluene was dispersed in a ball mill for 3 hours. Then, to the dispersion was added 2.5 g of 1,3-xylylenediisocyanate, and the mixture was further dispersed in a ball mill for 10 minutes.

The dispersion was coated on paper, which had been subjected to an electroconductive treatment, by a wire bar in a dry coverage of 20 g/m$^2$, heated for one minute at 110° C. and then heated for 1.5 hours at 120° C. Then, the coated material was allowed to stand in a dark place for 24 hours under the condition of 20° C. and 65% RH to prepare an electrophotographic light-sensitive material.

Resin (A-26):

-continued

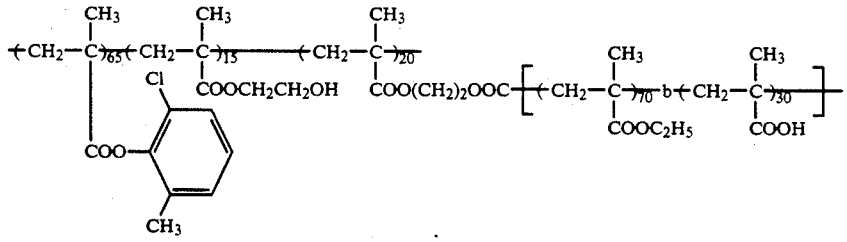

As the results of the evaluation as described in Example 28, it can be seen that the light-sensitive material according to the present invention is excellent in electrostatic characteristics and image-forming performance. Further, when the material was employed as an offset master plate precursor, more than 10,000 good prints were obtained.

It is believed that these results are obtained based on the increase in the film strength owing to the formation of crosslinkage between the curable groups included in Resin (A-36) upon the heat treatment after the coating of the photoconductive layer.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon a photoconductive layer containing at least an inorganic photoconductive substance and a binder resin, wherein the binder resin comprises (1) at least one graft type copolymer (Resin (A)) having a weight average molecular weight of from $1\times10^3$ to $2\times10^4$ and formed from, as a copolymerizable component, at least one mono-functional macromonomer (M) comprising an AB block copolymer composed of an A block comprising at least one polymer component containing at least one acidic group selected from $—PO_3H_2$, —COOH, $—CO_3H$, a phenolic hydroxyl group

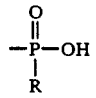

(wherein R represents a hydrocarbon group or —OR' (wherein R' represents a hydrocarbon group)) and a cyclic acid anhydride-containing group, and a B block containing at least one polymer component represented by the general formula (I) described below and having a polymerizable double bond group bonded to the terminal of the main chain of the B block polymer;

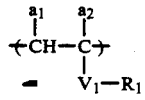

(I)

wherein $a_1$ and $a_2$ each represents a hydrogen atom, a halogen atom, a cyano group, a hydrocarbon group, $—COOZ_1$ or $—COOZ_1$ bonded via a hydrocarbon group (wherein $Z_1$ represents a hydrocarbon group); $V_1$ represents —COO—, —OCO—, $-(CH_2)_{l1}OCO—$, $-(CH_2)_{l2}COO—$ (wherein $l_1$ and $l_2$ each represents an integer of from 1 to 3), —O—, $—SO_2—$, —CO—,

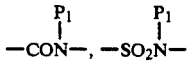

(wherein $P_1$ represent a hydrogen atom or a hydrocarbon group), —CONHCOO—, —CONHCONH—, or

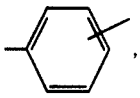

and $R_1$ represents a hydrocarbon group, provided that when $V_1$ represents

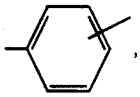

$R_1$ represents a hydrogen atom or a hydrocarbon group; and (2) at least one resin (Resin (B)) having a weight average molecular weight of $5\times10^4$ or more, containing a repeating unit represented by the general formula (III) described below, as a copolymer component, and having a crosslinked structure formed before the preparation of a dispersion for forming the photoconductive layer;

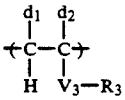

(III)

wherein $V_3$ represents —COO—, —OCO—, $—CH_2OCO—$, $—CH_2COO—$, —O—, or $—SO_2—$, $R_3$ represents a hydrocarbon group having from 1 to 22 carbon atoms; and $d_1$ and $d_2$, which may be the same or different, each represents a hydrogen atom, a halogen atom, a cyano group, a hydrocarbon group having from 1 to 8 carbon atoms, $—COOZ_3$, or $—COOZ_3$ bonded through a hydrocarbon group having from 1 to 8 carbon atoms, wherein $Z_3$ represents a hydrocarbon group having from 1 to 18 carbon atoms.

2. An electrophotographic light-sensitive material as claimed in claim 1, wherein the graft type copolymer contains, as a component copolymerizable with the macromonomer (M), at least one monomer represented by the following general formula (II):

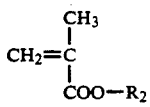

wherein $R_2$ represents a hydrocarbon group.

3. An electrophotographic light-sensitive material as claimed in claim 1, wherein the graft type copolymer contains, as a component copolymerizable with the macromonomer (M), a monomer represented by the following general formula (IIa) or (IIb):

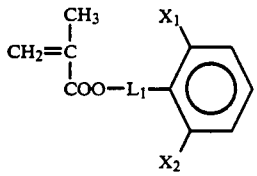

(IIa)

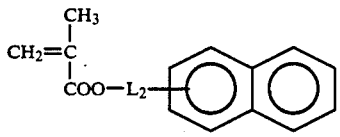

(IIb)

wherein $X_1$ and $X_2$ each, independently represents a hydrogen atom, a hydrocarbon group having from 1 to 10 carbon atoms, a chlorine atom, a bromine atom, $—COZ_2$ or $—COOZ_2$ (wherein $Z_2$ represents a hydrocarbon group having from 1 to 10 carbon atoms); and $L_1$ and $L_2$ each represents a mere bond or a linking group having from 1 to 4 linking atoms, which connects —COO— and the benzene ring.

4. An electrophotographic light-sensitive material as claimed in claim 1, wherein the content of the monofunctional macromonomer (M) in the resin (A) is from 1 to 60% by weight.

5. An electrophotographic light-sensitive material as claimed in claim 1, wherein the ratio of the A block/the B block in the macromonomer (M) is 1 to 70/99 to 30.

6. An electrophotographic light-sensitive material as claimed in claim 1, wherein the polymerizable double bond group is represented by the following general formula (IV):

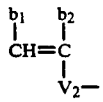

(IV)

wherein $b_1$ and $b_2$ each represents a hydrogen atom, a halogen atom, a cyano group, a hydrocarbon group, $—COOZ_1$ or $—COOZ_1$ bonded via a hydrocarbon group (wherein $Z_1$ represents a hydrocarbon group); and $V_2$ represents —COO—, —OCO—, $-(CH_2)_{l1}$OCO—, $-(CH_2)_{l2}$COO— (wherein $l_1$ and $l_2$ each represents an integer of from 1 to 3), —O—, $—SO_2—$, —CO—,

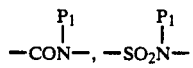

(wherein $P_1$ represent a hydrogen atom or a hydrocarbon group), —CONHCOO—, —CONHCONH—, or

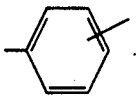

7. An electrophotographic light-sensitive material as claimed in claim 1, wherein a weight average molecular weight of the macromonomer (M) is from $1\times10^3$ to $2\times10^4$.

8. An electrophotographic light-sensitive material as claimed in claim 1, wherein the graft type copolymer has a weight average molecular weight of from $3\times10^3$ to $1\times10^4$.

9. An electrophotographic light-sensitive material as claimed in claim 1, wherein the content of the polymerizable component containing the acidic group in the graft copolymer is from 1 to 20 parts by weight per 100 parts by weight of the resin (A).

10. An electrophotographic light-sensitive material as claimed in claim 3, wherein the linking group containing from 1 to 4 linking atoms represented by $L_1$ or $L_2$ is $-(CH_2)_{m1}$ ($m_1$ represents an integer of 1, 2 or 3), $—CH_2CH_2OCO—$, $-(CH_2O)_{m2}$ ($m_2$ represents an integer of 1 or 2), or $—CH_2CH_2O—$.

11. An electrophotographic light-sensitive material as claimed in claim 1, wherein the weight average molecular weight of the resin (B) is from $8\times10^4$ to $6\times10^5$.

12. An electrophotographic light-sensitive material as claimed in claim 1, wherein the resin (B) has at least one polar group selected from $—PO_3H_2$, $—SO_3H$, —COOH, —OH, —SH,

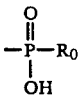

(wherein $R_0$ represents a hydrocarbon group or $—OR_0'$, wherein $R_0'$ represents a hydrocarbon group), a cyclic acid anhydride containing group, —CHO, $—CONH_2$, $—SO_2NH_2$, and

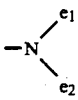

(wherein $e_1$ and $e_2$, which may be the same or different, each represents a hydrogen atom or a hydrocarbon group) at only one terminal of at least one polymer main chain thereof.

13. An electrophotographic light-sensitive material as claimed in claim 1, wherein a ratio of the resin (A)/the resin (B) is 5 to 60/95 to 40.

14. An electrophotographic light-sensitive material as claimed in claim 1, wherein the photoconductive layer further contains a spectral sensitizer.

15. An electrophotographic light-sensitive material as claimed in claim 14, wherein the spectral sensitizer is a polymethine dye capable of spectrally sensitizing in the wavelength region of 700 nm or more.

16. An electrophotographic light-sensitive material as claimed in claim 1, wherein the photoconductive layer further contains a chemical sensitizer.

* * * * *